US007815500B2

(12) United States Patent
Montross et al.

(10) Patent No.: US 7,815,500 B2
(45) Date of Patent: Oct. 19, 2010

(54) GAMING DEVICE HAVING A PREDETERMINED RESULT POKER GAME

(75) Inventors: John M. Montross, Reno, NV (US); Michael J. Mason, Reno, NV (US)

(73) Assignee: IGT, Reno, NV (US)

( * ) Notice: Subject to any disclaimer, the term of this patent is extended or adjusted under 35 U.S.C. 154(b) by 293 days.

(21) Appl. No.: 11/031,663

(22) Filed: Jan. 7, 2005

(65) Prior Publication Data

US 2006/0154714 A1 Jul. 13, 2006

(51) Int. Cl.
*A63F 9/24* (2006.01)

(52) U.S. Cl. ..... 463/13; 463/17; 273/274

(58) Field of Classification Search ..... 463/16, 463/20, 21, 22, 26, 13, 17; 273/292, 274
See application file for complete search history.

(56) References Cited

U.S. PATENT DOCUMENTS

| | | | |
|---|---|---|---|
| 3,628,259 | A | 12/1971 | Kahn |
| 4,156,976 | A | 6/1979 | Mikun |
| 4,157,829 | A | 6/1979 | Goldman et al. |
| 4,332,389 | A | 6/1982 | Loyd et al. |
| 4,335,809 | A | 6/1982 | Wain |
| 4,339,798 | A | 7/1982 | Hedges et al. |
| 4,365,810 | A | 12/1982 | Richardson |
| 4,373,726 | A | 2/1983 | Churchill et al. |
| 4,448,419 | A | 5/1984 | Telnaes |
| 4,455,025 | A | 6/1984 | Itkis |
| 4,467,424 | A | 8/1984 | Hedges et al. |
| 4,494,197 | A | 1/1985 | Troy et al. |
| 4,527,798 | A | 7/1985 | Siekierski et al. |

(Continued)

FOREIGN PATENT DOCUMENTS

| | | |
|---|---|---|
| EP | 0769769 | 4/1997 |

(Continued)

OTHER PUBLICATIONS

Diamonopoly Advertisement by International Gamco, Inc., published 2002.

(Continued)

*Primary Examiner*—William M Pierce
(74) *Attorney, Agent, or Firm*—K&L Gates LLP

(57) ABSTRACT

An interactive poker game which provides a predetermined outcome to a player. The gaming device initially displays a plurality of individual sets or hands of face down playing cards. The gaming device determines, based on the obtained predetermined game outcome, one or more playing cards to display to the player for one or more of the individual hands of playing cards. The gaming device then enables the player to select one of the individual poker hands to play as the player's active poker hand. The gaming device determines which playing cards must be provided to the actively played poker hand to provide the player the selected predetermined game outcome. The active poker hand is provided any determined cards which when combined with any previously revealed playing cards in the player selected poker hands results in a poker hand with an associated payout equal to the payout associated with the predetermined game outcome. The gaming device determines, preferably randomly, and displays one or more playing cards for each of the non-selected hands of playing cards and provides the predetermined game outcome to the player.

13 Claims, 12 Drawing Sheets

U.S. PATENT DOCUMENTS

| | | | | | |
|---|---|---|---|---|---|
| 4,582,324 | A | | 4/1986 | Koza et al. | |
| 4,624,462 | A | | 11/1986 | Itkis | |
| 4,636,951 | A | | 1/1987 | Harlick | |
| 4,652,998 | A | | 3/1987 | Koza et al. | |
| 4,669,730 | A | | 6/1987 | Small | |
| 4,679,143 | A | | 7/1987 | Hagiwara | |
| 4,689,742 | A | | 8/1987 | Troy et al. | |
| 4,798,387 | A | | 1/1989 | Richardson | |
| 4,805,907 | A | | 2/1989 | Hagiwara | |
| 4,815,741 | A | | 3/1989 | Small | |
| 4,817,951 | A | * | 4/1989 | Crouch et al. | 463/20 |
| 4,842,278 | A | | 6/1989 | Markowicz | |
| 4,848,771 | A | | 7/1989 | Richardson | |
| 4,856,787 | A | | 8/1989 | Itkis | |
| 4,880,237 | A | | 11/1989 | Kishishita | |
| 4,882,473 | A | | 11/1989 | Bergeron et al. | |
| 4,982,337 | A | | 1/1991 | Burr et al. | |
| 5,007,649 | A | | 4/1991 | Richardson | |
| 5,011,159 | A | | 4/1991 | Fortunato et al. | |
| 5,042,809 | A | | 8/1991 | Richardson | |
| 5,092,598 | A | | 3/1992 | Kamille | |
| 5,100,137 | A | | 3/1992 | Fulton | |
| 5,118,109 | A | * | 6/1992 | Gumina | 273/139 |
| 5,119,295 | A | | 6/1992 | Kapur | |
| 5,158,293 | A | | 10/1992 | Mullins | |
| 5,167,413 | A | | 12/1992 | Fulton | |
| 5,223,698 | A | | 6/1993 | Kapur | |
| 5,224,706 | A | | 7/1993 | Bridgeman et al. | |
| 5,242,163 | A | | 9/1993 | Fulton | |
| 5,265,874 | A | | 11/1993 | Dickinson et al. | |
| 5,275,400 | A | | 1/1994 | Weingardt et al. | |
| 5,276,312 | A | | 1/1994 | McCarthy | |
| 5,282,620 | A | | 2/1994 | Keesee | |
| 5,294,120 | A | | 3/1994 | Schultz | |
| 5,294,128 | A | | 3/1994 | Marquez | |
| 5,297,802 | A | | 3/1994 | Pocock et al. | |
| 5,324,035 | A | | 6/1994 | Morris et al. | |
| 5,326,104 | A | | 7/1994 | Pease et al. | |
| 5,348,299 | A | | 9/1994 | Clapper, Jr. | |
| 5,351,970 | A | | 10/1994 | Fioretti | |
| 5,356,140 | A | | 10/1994 | Dabrowski et al. | |
| 5,377,975 | A | | 1/1995 | Clapper, Jr. | |
| 5,393,057 | A | | 2/1995 | Marnell, II | |
| 5,393,061 | A | | 2/1995 | Manship et al. | |
| 5,398,932 | A | | 3/1995 | Eberhardt et al. | |
| 5,401,023 | A | | 3/1995 | Wood | |
| 5,407,199 | A | | 4/1995 | Gumina | |
| 5,476,259 | A | | 12/1995 | Weingardt | |
| 5,487,544 | A | | 1/1996 | Clapper, Jr. | |
| 5,489,101 | A | | 2/1996 | Moody | |
| 5,511,781 | A | | 4/1996 | Wood et al. | |
| 5,531,440 | A | | 7/1996 | Dabrowski et al. | |
| 5,531,441 | A | | 7/1996 | Dabrowski et al. | |
| 5,531,448 | A | | 7/1996 | Moody | |
| 5,536,008 | A | | 7/1996 | Clapper, Jr. | |
| 5,542,669 | A | | 8/1996 | Charron et al. | |
| 5,562,284 | A | | 10/1996 | Stevens | |
| 5,564,701 | A | | 10/1996 | Dettor | |
| 5,570,885 | A | | 11/1996 | Ornstein | |
| 5,580,311 | A | | 12/1996 | Haste, III | |
| 5,584,486 | A | | 12/1996 | Franklin | |
| 5,588,913 | A | | 12/1996 | Hecht | |
| 5,593,161 | A | | 1/1997 | Boylan et al. | |
| 5,595,538 | A | | 1/1997 | Haste, III | |
| 5,609,337 | A | | 3/1997 | Clapper, Jr. | |
| 5,628,684 | A | | 5/1997 | Boudec | |
| 5,630,754 | A | | 5/1997 | Rebane | |
| 5,639,088 | A | * | 6/1997 | Schneider et al. | 273/138.2 |
| 5,645,485 | A | | 7/1997 | Clapper, Jr. | |
| 5,657,899 | A | | 8/1997 | Stoken | |
| 5,674,128 | A | | 10/1997 | Holch et al. | |
| 5,678,001 | A | | 10/1997 | Nagel et al. | |
| 5,697,843 | A | | 12/1997 | Manship et al. | |
| 5,707,285 | A | | 1/1998 | Place et al. | |
| 5,711,715 | A | | 1/1998 | Ringo et al. | |
| 5,718,431 | A | | 2/1998 | Ornstein | |
| 5,720,483 | A | | 2/1998 | Trinh | |
| 5,722,891 | A | | 3/1998 | Inoue | |
| 5,732,950 | A | | 3/1998 | Moody | |
| 5,735,432 | A | | 4/1998 | Stoken et al. | |
| 5,749,784 | A | | 5/1998 | Clapper, Jr. | |
| 5,755,621 | A | | 5/1998 | Marks et al. | |
| 5,762,552 | A | | 6/1998 | Thanh et al. | |
| 5,772,506 | A | | 6/1998 | Marks et al. | |
| 5,775,692 | A | | 7/1998 | Watts et al. | |
| 5,779,545 | A | | 7/1998 | Berg et al. | |
| 5,779,547 | A | | 7/1998 | SoRelle et al. | |
| 5,791,987 | A | | 8/1998 | Chen et al. | |
| 5,800,269 | A | | 9/1998 | Holch et al. | |
| 5,810,664 | A | | 9/1998 | Clapper, Jr. | |
| 5,816,916 | A | | 10/1998 | Moody | |
| 5,823,873 | A | * | 10/1998 | Moody | 463/13 |
| 5,823,874 | A | | 10/1998 | Adams | |
| 5,830,067 | A | | 11/1998 | Graves et al. | |
| 5,833,540 | A | | 11/1998 | Miodunski et al. | |
| 5,836,586 | A | | 11/1998 | Marks et al. | |
| 5,848,932 | A | | 12/1998 | Adams | |
| 5,853,325 | A | * | 12/1998 | Kadlic | 463/13 |
| 5,855,515 | A | | 1/1999 | Pease et al. | |
| 5,868,619 | A | | 2/1999 | Wood et al. | |
| 5,871,398 | A | | 2/1999 | Schneier et al. | |
| 5,876,283 | A | | 3/1999 | Parra et al. | |
| 5,882,258 | A | | 3/1999 | Kelly et al. | |
| 5,882,260 | A | | 3/1999 | Marks et al. | |
| 5,915,588 | A | | 6/1999 | Stoken et al. | |
| 5,928,082 | A | | 7/1999 | Clapper, Jr. | |
| 5,941,771 | A | | 8/1999 | Haste, III | |
| 5,944,606 | A | | 8/1999 | Gerow | |
| 5,949,042 | A | | 9/1999 | Dietz, II et al. | |
| 5,954,335 | A | | 9/1999 | Moody | |
| 5,954,582 | A | | 9/1999 | Zach | |
| 5,976,016 | A | | 11/1999 | Moody et al. | |
| 5,980,385 | A | | 11/1999 | Clapper, Jr. | |
| 5,984,779 | A | | 11/1999 | Bridgeman et al. | |
| 6,007,066 | A | | 12/1999 | Moody | |
| 6,007,424 | A | | 12/1999 | Evers et al. | |
| 6,012,720 | A | | 1/2000 | Webb | |
| 6,012,981 | A | | 1/2000 | Fujioka et al. | |
| 6,012,984 | A | | 1/2000 | Roseman | |
| 6,017,032 | A | | 1/2000 | Grippo et al. | |
| 6,024,640 | A | | 2/2000 | Walker et al. | |
| 6,056,289 | A | | 5/2000 | Clapper, Jr. | |
| 6,062,980 | A | | 5/2000 | Luciano | |
| 6,062,981 | A | | 5/2000 | Luciano, Jr. | |
| 6,079,711 | A | | 6/2000 | Wei et al. | |
| 6,089,982 | A | | 7/2000 | Holch et al. | |
| 6,093,100 | A | | 7/2000 | Singer et al. | |
| 6,098,985 | A | | 8/2000 | Moody | |
| 6,113,102 | A | | 9/2000 | Marks et al. | |
| 6,120,024 | A | | 9/2000 | Lind | |
| 6,120,378 | A | | 9/2000 | Moody et al. | |
| 6,126,541 | A | | 10/2000 | Fuchs | |
| 6,126,542 | A | | 10/2000 | Fier | |
| 6,132,311 | A | | 10/2000 | Williams | |
| 6,146,271 | A | | 11/2000 | Kadlic | |
| 6,146,272 | A | | 11/2000 | Walker et al. | |
| 6,149,156 | A | | 11/2000 | Feola | |
| 6,149,521 | A | | 11/2000 | Sanduski | |
| 6,155,925 | A | | 12/2000 | Giobbi et al. | |
| 6,159,095 | A | | 12/2000 | Frohm et al. | |
| 6,168,521 | B1 | | 1/2001 | Luciano et al. | |
| 6,174,233 | B1 | | 1/2001 | Sunaga et al. | |
| 6,183,361 | B1 | | 2/2001 | Cummings et al. | |
| 6,190,255 | B1 | | 2/2001 | Thomas et al. | |

| | | | | |
|---|---|---|---|---|
| 6,196,547 | B1 | 3/2001 | Pascal et al. | |
| 6,203,429 | B1 | 3/2001 | Demar et al. | |
| 6,210,275 | B1 | 4/2001 | Olsen | |
| 6,210,276 | B1 | 4/2001 | Mullins | |
| 6,217,448 | B1 | 4/2001 | Olsen | |
| 6,220,961 | B1 | 4/2001 | Keane et al. | |
| 6,241,606 | B1 * | 6/2001 | Riendeau et al. | 463/17 |
| 6,254,480 | B1 | 7/2001 | Zach | |
| 6,273,820 | B1 | 8/2001 | Haste, III | |
| 6,280,325 | B1 | 8/2001 | Fisk | |
| 6,280,328 | B1 | 8/2001 | Holch et al. | |
| 6,302,791 | B1 | 10/2001 | Frohm et al. | |
| 6,306,038 | B1 | 10/2001 | Graves et al. | |
| 6,309,298 | B1 | 10/2001 | Gerow | |
| 6,312,334 | B1 | 11/2001 | Yoseloff | |
| 6,315,289 | B1 | 11/2001 | Sakamoto et al. | |
| 6,325,716 | B1 | 12/2001 | Walker et al. | |
| 6,358,150 | B1 | 3/2002 | Mir et al. | |
| 6,358,151 | B1 | 3/2002 | Enzminger et al. | |
| 6,368,218 | B2 | 4/2002 | Angell, Jr. | |
| 6,386,977 | B1 | 5/2002 | Hole | |
| 6,402,614 | B1 | 6/2002 | Schneier et al. | |
| 6,419,583 | B1 | 7/2002 | Crumby et al. | |
| 6,425,824 | B1 | 7/2002 | Baerlocher et al. | |
| 6,447,395 | B1 | 9/2002 | Stevens | |
| 6,450,885 | B2 | 9/2002 | Schneier et al. | |
| 6,454,648 | B1 | 9/2002 | Kelly et al. | |
| RE37,885 | E | 10/2002 | Acres et al. | |
| 6,471,591 | B1 * | 10/2002 | Crumby | 463/26 |
| 6,474,645 | B2 * | 11/2002 | Tarantino | 273/274 |
| 6,475,086 | B2 | 11/2002 | Zach | |
| 6,508,711 | B1 | 1/2003 | Ono | |
| 6,524,184 | B1 | 2/2003 | Lind et al. | |
| 6,524,185 | B2 | 2/2003 | Lind | |
| 6,527,638 | B1 | 3/2003 | Walker et al. | |
| 6,533,664 | B1 | 3/2003 | Crumby | |
| 6,537,150 | B1 * | 3/2003 | Luciano et al. | 463/16 |
| 6,569,013 | B1 | 5/2003 | Taylor | |
| 6,569,017 | B2 | 5/2003 | Enzminger et al. | |
| 6,585,587 | B2 * | 7/2003 | Falciglia, Sr. | 463/13 |
| 6,599,187 | B2 | 7/2003 | Gerow | |
| 6,607,439 | B2 | 8/2003 | Schneier et al. | |
| 6,609,974 | B2 | 8/2003 | Mead et al. | |
| 6,612,926 | B1 | 9/2003 | Dabrowski | |
| 6,612,927 | B1 | 9/2003 | Slomiany et al. | |
| 6,619,660 | B2 | 9/2003 | Schaefer et al. | |
| 6,656,040 | B1 | 12/2003 | Brosnan et al. | |
| 6,656,044 | B1 | 12/2003 | Lewis | |
| 6,676,126 | B1 | 1/2004 | Walker et al. | |
| 6,685,562 | B1 | 2/2004 | Rantanen | |
| 6,695,695 | B2 | 2/2004 | Angel | |
| 6,708,975 | B1 * | 3/2004 | Fox et al. | 273/292 |
| 6,722,655 | B1 | 4/2004 | Camero | |
| 6,729,621 | B2 * | 5/2004 | Moody | 273/292 |
| 6,729,961 | B1 * | 5/2004 | Millerschone | 463/30 |
| 6,733,385 | B1 * | 5/2004 | Enzminger et al. | 463/17 |
| 6,749,500 | B1 * | 6/2004 | Nelson et al. | 463/13 |
| 6,840,858 | B2 | 1/2005 | Adams | |
| 6,877,747 | B2 * | 4/2005 | Moody | 273/292 |
| 6,964,609 | B2 * | 11/2005 | Haag et al. | 463/20 |
| 6,986,709 | B2 * | 1/2006 | Hughs-Baird et al. | 463/16 |
| 6,988,946 | B2 * | 1/2006 | Michaelson et al. | 463/17 |
| 7,022,016 | B2 * | 4/2006 | Wood et al. | 463/13 |
| 7,056,210 | B2 * | 6/2006 | Bansemer et al. | 463/16 |
| 7,112,133 | B2 * | 9/2006 | Lyons | 463/16 |
| 7,338,371 | B2 * | 3/2008 | Cheng et al. | 463/25 |
| 7,387,568 | B2 * | 6/2008 | Millerschone | 463/17 |
| 7,390,258 | B2 * | 6/2008 | Millerschone | 463/17 |
| 7,393,276 | B2 * | 7/2008 | Millerschone | 463/17 |
| 7,425,176 | B2 * | 9/2008 | Nelson et al. | 463/13 |
| 7,431,644 | B2 * | 10/2008 | Moody | 463/13 |
| 7,470,183 | B2 * | 12/2008 | Wishart | 463/16 |
| 7,473,176 | B2 * | 1/2009 | Michaelson | 463/21 |
| 7,479,062 | B2 * | 1/2009 | Michaelson | 463/21 |
| 7,524,243 | B2 * | 4/2009 | Bansemer et al. | 463/13 |
| 2001/0036855 | A1 | 11/2001 | DeFrees-Parrott et al. | |
| 2002/0010013 | A1 | 1/2002 | Walker et al. | |
| 2002/0039917 | A1 * | 4/2002 | Armstrong et al. | 463/16 |
| 2002/0077173 | A1 | 6/2002 | Luciano et al. | |
| 2002/0077174 | A1 | 6/2002 | Luciano et al. | |
| 2002/0082070 | A1 | 6/2002 | Macke et al. | |
| 2002/0082071 | A1 | 6/2002 | Riendeau et al. | |
| 2002/0082085 | A1 | 6/2002 | Osterer | |
| 2002/0090986 | A1 | 7/2002 | Cote et al. | |
| 2002/0094869 | A1 | 7/2002 | Harkham | |
| 2002/0094871 | A1 | 7/2002 | Luciano et al. | |
| 2002/0098882 | A1 | 7/2002 | Lind et al. | |
| 2002/0098883 | A1 | 7/2002 | Packes, Jr. et al. | |
| 2002/0111207 | A1 | 8/2002 | Lind et al. | |
| 2002/0111214 | A1 | 8/2002 | Clifton et al. | |
| 2002/0113369 | A1 | 8/2002 | Weingardt | |
| 2002/0132661 | A1 | 9/2002 | Lind et al. | |
| 2002/0132666 | A1 | 9/2002 | Lind et al. | |
| 2002/0196342 | A1 | 12/2002 | Walker et al. | |
| 2003/0060257 | A1 | 3/2003 | Katz et al. | |
| 2003/0060261 | A1 | 3/2003 | Katz et al. | |
| 2003/0060276 | A1 | 3/2003 | Walker et al. | |
| 2003/0100371 | A1 | 5/2003 | Gatto et al. | |
| 2003/0100372 | A1 | 5/2003 | Gatto et al. | |
| 2003/0125101 | A1 | 7/2003 | Campo | |
| 2003/0181231 | A1 | 9/2003 | Vancura et al. | |
| 2003/0190943 | A1 | 10/2003 | Walker et al. | |
| 2003/0211884 | A1 | 11/2003 | Gauselmann | |
| 2004/0014515 | A1 | 1/2004 | Tracy et al. | |
| 2004/0036212 | A1 | 2/2004 | Walker et al. | |
| 2004/0038723 | A1 | 2/2004 | Schneier et al. | |
| 2004/0248641 | A1 | 12/2004 | Jarvis et al. | |
| 2005/0233798 | A1 | 10/2005 | Van Asdale | |

FOREIGN PATENT DOCUMENTS

| | | |
|---|---|---|
| EP | 1302914 | 4/2003 |
| EP | 1343125 | 9/2003 |
| WO | 9618174 | 6/1996 |
| WO | 0199067 | 12/2001 |
| WO | WO 02097749 | 12/2002 |

OTHER PUBLICATIONS

Electronic Pull Tabs Advertisement by 21st Century Gaming, published prior to 2002.

Lucky Times California Lottery Newsletter published 1996.

Instant Winner Advertisement by Williams/WMS Gaming, published prior to 2002.

Play it again Advertisement by International Gamco, Inc., published 2000.

* cited by examiner

GAMING DEVICE HAVING A PREDETERMINED RESULT POKER GAME

CROSS-REFERENCE TO RELATED APPLICATIONS

This application relates to the following co-pending commonly owned patent applications: "GAMING DEVICE INCLUDING OUTCOME POOLS FOR PROVIDING GAME OUTCOMES," Ser. No. 10/261,744; "APPARATUS AND METHOD FOR GENERATING A POOL OF SEEDS FOR A CENTRAL DETERMINATION GAMING SYSTEM," Ser. No. 10/371,722; "CENTRAL DETERMINATION GAMING SYSTEM WITH A CENTRAL CONTROLLER PROVIDING A GAME OUTCOME AND A GAMING TERMINAL DETERMINING A PRESENTATION OF THE PROVIDED GAME OUTCOME," Ser. No. 10/371,723; "CENTRAL DETERMINATION GAMING SYSTEM WHERE THE SAME SEED IS USED TO GENERATE THE OUTCOMES FOR A PRIMARY GAME AND A SECONDARY GAME," Ser. No. 10/371,958; "CENTRAL DETERMINATION GAMING SYSTEM WHICH PROVIDES A PLAYER A CHOICE IN OUTCOMES," Ser. No. 10/442,318; "CENTRAL DETERMINATION GAMING SYSTEM WITH A GAME OUTCOME GENERATED BY A GAMING TERMINAL AND APPROVED BY A CENTRAL CONTROLLER," Ser. No. 10/383,423; "CENTRAL DETERMINATION GAMING SYSTEM WITH A GAMING TERMINAL ASSISTING THE CENTRAL CONTROLLER IN THE GENERATION OF A GAME OUTCOME," Ser. No. 10/431,755, "CENTRAL DETERMINATION GAMING SYSTEM WITH A KENO GAME," Ser. No. 10/601,482; "GAMING DEVICE HAVING AN INTERACTIVE POKER GAME WITH PREDETERMINED OUTCOMES," Ser. No. 10/934,258; "CENTRAL DETERMINATION POKER GAME," Ser. No. 10/945,642; "CENTRAL DETERMINATION OFFER AND ACCEPTANCE GAME WITH MULTIPLIER," Ser. No. 11/048,220; "APPARATUS AND METHOD FOR GENERATING A POOL OF SEEDS FOR A CENTRAL DETERMINATION GAMING SYSTEM," Ser. No. 11/046,354; "METHOD FOR DISPLAYING AN INTERACTIVE GAME HAVING A PREDETERMINED OUTCOME," Ser. No. 10/829,578; "METHOD FOR DISPLAYING AN INTERACTIVE GAME HAVING A PREDETERMINED OUTCOME," Ser. No. 10/846,448; "METHOD FOR DISPLAYING AN INTERACTIVE GAME HAVING A PREDETERMINED OUTCOME," Ser. No. 10/864,784; and "STUD BINGO," Ser. No. 11/031,048.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

The present invention relates in general to a card game and more particularly to a gaming device having a predetermined result poker game.

The majority of the contemporary wagering gaming devices or gaming terminals, such as slot machines or poker games, randomly generate awards and other outcomes. Such gaming terminals typically include a relatively low probability associated with obtaining the highest award, relatively medium probabilities associated with obtaining medium range awards and relatively higher probabilities associated with obtaining low range awards. These gaming terminals also include probabilities associated with obtaining losses or no award at all. The probabilities of obtaining the awards and the amount of the awards determine the average expected pay out percentage of these wagering gaming terminals. Because the outcomes of these gaming terminals are completely randomly determined, there is no certainty that a player will ever obtain any particular award. No matter how many times a player plays the game, since the gaming terminal generates outcomes randomly or completely based upon a probability calculation, there is no certainty that the game will ever provide the player with a rare outcome, such as a jackpot award, or any other specific value for that matter. On the other hand, due to the random determination, the gaming terminal can provide the rare outcomes, such as jackpot awards, numerous times in a small number of plays. For example, a probability-based $1 poker machine gaming terminal may be programmed to payback 95% of all wagers placed with a 1% chance of generating a $10 win outcome, a 5% chance of generating a $5 win outcome, a 10% chance of generating a $2 win outcome, a 40% chance of generating a $1 win outcome and a 44% chance of generating a $0 loss outcome. However, when one hundred game outcomes are generated by the probability-based poker machine gaming terminal, the actual payback may be 137% of all wagers placed and the actual generated outcomes may be six $10 win outcomes, one $5 win outcome, eighteen $2 win outcomes, thirty-six $1 win outcomes and thirty-nine $0 loss outcomes.

This uncertainty is faced by players and casinos or other gaming establishments. For example, certain casinos prefer that a relatively high number of players hit low awards while a relatively low number of players hit high awards. When players hit high awards periodically, casinos attract more players, because of the positive publicity large wins generate. By using desired payback percentages or probabilities, the casinos can also expect to make a certain level of profit. The random determinations can, however, unexpectedly cause casinos to suffer a loss or, on the other hand, to reap great profit in the short run and lose business in the long run due to a reputation for only paying out low awards.

Regulatory bodies in certain jurisdictions do not permit the use of probability-based gaming terminals in-part for these reasons. These regulatory bodies permit the use of wagering gaming terminals which are guaranteed to provide certain or definite awards, so that, for example, a certain number of wins is guaranteed and the overall amount paid back to players is guaranteed. That is, the payback percentage is fixed and not an average expected amount. One type of gaming terminal which complies with this requirement is an instant-type lottery gaming terminal. An instant-type lottery gaming terminal includes a finite pool or set of electronic tickets with each electronic ticket assigned to a predetermined outcome. Alternatively, each electronic ticket could be assigned to a random number or game play seed which is deterministic of a predetermined outcome. In this embodiment, the gaming terminal utilizes the random number or game play seed in a random number generating algorithm to generate random numbers that the gaming terminal then uses to determine and provide the predetermined outcome. In an instant-type lottery gaming terminal, as the predetermined outcome for each electronic ticket is revealed to a player on the gaming terminal, the ticket is removed (i.e., flagged as used) from the finite pool or set of electronic tickets. Once removed from the pool or set, a ticket cannot be used again to determine another game outcome. This type of gaming terminal provides players with all of the available outcomes over the course of the play cycle and guarantees the actual wins and losses.

Since an instant-type lottery gaming machine has a finite pool of predetermined win/loss outcomes, it is possible to configure the pool to specific conditions or criteria requested by the casino or gaming establishment. An example of these conditions or criteria are the number of tickets included in the pool and the exact payback percentage or payback sum for the pool as a whole. The payback percentage or sum represents the guaranteed payout for the entire pool of predetermined outcomes. Other examples of conditions or criteria are what prizes will be awarded and the frequency of winning outcome tickets amongst the total number of tickets for the pool. For example, if a predetermined pool includes twenty $1 tickets and the pool has a payback sum of $10, then the pool might consist of one $5 win outcome, one $2 win outcome, three $1 win outcomes and fifteen $0 loss outcomes and may be represented as the following outcomes: 5, 2, 1, 1, 1, 0, 0, 0, 0, 0, 0, 0, 0, 0, 0, 0, 0, 0, 0, 0. It should be appreciated that the above described pool of twenty tickets is for illustration purposes only and a pool could include any suitable desired number of tickets including a large number such as one million or more.

It should be appreciated that even though a pool may contain more than one of the same game outcome (i.e., the loss or the win and if a win, the value), the presentation to the player (such as the cards dealt or drawn in the case of simulated card games) is preferably varied for each sequential game outcome. For example, in the twenty ticket pool described above, while three game outcomes may each determine a win game outcome with a value of $1, in a poker game machine each game outcome will be preferably presented to the player as one of a plurality of different card combinations that all yield the same $1 win outcome.

Central determination gaming systems are also generally known. A central determination gaming system provides a plurality of individual gaming terminals, located in a gaming establishment, such as a casino, coupled by one or more communication links, to a central processor or controller. When a player plays a game on one of the gaming terminals, a game outcome is randomly generated based on probability data by the central controller. The generated game outcome and how the game outcome is to be presented or displayed to the player are communicated from the central controller to the individual gaming terminal and then provided to the player. It should be appreciated that one central processor may continuously run hundreds or thousands of individual gaming terminals at once. Additionally, each individual gaming terminal may include a plurality of different types of games played at a plurality of different denominations.

In order to comply with the above mentioned regulatory rules that do not permit the use of probability-based gaming terminals, central determination gaming systems have been implemented wherein the central system maintains one or more predetermined pools or sets of game outcomes. Each game outcome in each set or pool includes a game outcome component (i.e., a win, a loss, a secondary game trigger or other suitable outcome) with an associated value or payout amount, if any, and a game presentation component (i.e., how the game outcome is displayed or presented to the player). In these systems, when a player makes a wager on one of the gaming devices, the central system independently selects a game outcome from a set or pool of game outcomes and flags or marks the selected game outcome as used. Once a game outcome is flagged as used, it is prevented from further selection from the set or pool and cannot be selected by the central controller upon another wager. The selected game outcome is communicated to the individual gaming terminal. The individual gaming terminal displays or presents the game presentation component and provides the player the game outcome component with the associated value, if any, for the selected game outcome. Additionally, certain central determination gaming systems have also been implemented wherein the central system maintains one or more predetermined pools or sets of random number or game outcome seeds.

Central production or control can assist a casino or other entity in maintaining appropriate records, controlling gaming, reducing and preventing cheating or electronic or other errors, reducing or eliminating win-loss volatility and the like. However, it should be appreciated that some existing central determination gaming systems involve minimal to no player interaction other than initiating a game play at a gaming terminal. That is, similar to an instant type lottery game, the central controller selects a game outcome from the pool and the selected game outcome is provided to the player with the player unable to influence the provided game outcome. Therefore, a need exists for a central determination gaming system that provides an increased level of player interaction while still providing a predetermined game outcome to a player.

As described above, in addition to central determination gaming systems, other known gaming devices are operable to provide a player a predetermined outcome. In these gaming devices, rather than receiving an outcome from a central controller, the gaming device stores a plurality of predetermined outcomes in a memory device. Upon a player initiating a game at the gaming device, the predetermined outcome which will ultimately be provided to the player is selected and flagged or marked as used. The gaming device then proceeds with one or more game sequences and upon the conclusion of the game sequences, the selected predetermined outcome is provided to the player.

Poker games such as draw poker games are also well known. In a draw poker game, a gaming device initially deals five cards all face up from a conventional virtual deck of fifty-two playing cards. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and replacement cards are dealt from the remaining cards in the deck. This results in a second five-card hand. The second five-card hand is compared to a payout table which utilizes conventional poker hand rankings to determine the winning hands. The player is provided with an award based on a winning hand and the credits the player wagered.

In another embodiment, the poker game may include multiple hands of poker played simultaneously. In this embodiment, the player is dealt at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand compared to a payout table and awards are provided to the player.

Some known gaming devices have attempted to provide a poker game wherein the outcome is predetermined. In these known games, a player is shown a first hand of cards and invited to select one or more cards to be discarded. The player is then shown a second hand and a payoff is provided if the second hand is a winning hand according to a predetermined payout schedule. In these games, the initial hand and the second hand are both predetermined prior to the time the game is started. For this reason, there can often be an inconsistency between the player's selection of cards that are to be discarded and the transition from the initial hand to the second hand. This inconsistency can interfere with the desired simulation of a card game which provides a predetermined outcome.

One known gaming device described in U.S. Pat. No. 6,729,961 includes a poker game wherein an initial hand of cards is displayed to a player. The player designates which of the initial hand of cards are to be held and which are to be discarded and the game displays an intermediate hand generated in accordance with the player-specified designations. In this gaming device, a second hand which is associated with a value equal to the value associated with the predetermined game outcome is shown and in those cases where the player-specified designation (Hold/Discard) is inconsistent with a transition from the intermediate hand to the second hand, an entertaining display is shown and the predetermined game outcome is provided to the player.

Additionally, if there is an inconsistency between the award provided for the player's second hand which is based on the player's selections of cards to be discarded and the award associated with the predetermined outcome, other known gaming devices employ a mystery win card to increase the provided win amount up to the win amount associated with the predetermined game outcome. In other known gaming devices, any inconsistency between the award provided for the player's second hand which is based on the player's selections of cards to be discarded and the award associated with the predetermined outcome is held in an escrow or progressive pool to be subsequently provided to a player.

A need exists for new and different cards games and in particular, poker games which provide a predetermined game outcome to the player.

SUMMARY OF THE INVENTION

The present invention relates to a gaming device having a predetermined result interactive game. In one embodiment, a plurality of individual sets or hands of playing cards are initially displayed to a player. Based on a selected predetermined game outcome, one or more playing cards are determined to be displayed to the player for one or more of the individual hands of playing cards and the remaining cards are not displayed (i.e., initially dealt face down). The gaming device enables the player to select one of the individual poker hands to play as the player's active poker hand. The gaming device then determines which playing cards must be provided to the actively played poker hand to provide the player the selected predetermined game outcome. The active poker hand is provided any determined cards which when combined with any previously revealed playing cards in the player selected poker hands results in a poker hand with an associated payout equal to the payout associated with the predetermined game outcome. The gaming device determines, preferably randomly, and displays one or more playing cards for each of the non-selected hands of playing cards and provides the predetermined game outcome to the player.

In one embodiment, the predetermined game outcome is stored in a central controller. In this embodiment, upon a player initiating game play at the gaming device, the initiated gaming device communicates a game outcome request to the central server or controller. Upon receiving the game outcome request, the central controller independently selects a game outcome from a set or pool of game outcomes and flags or marks the selected game outcome as used. Once a game outcome is flagged as used, it is prevented from further selection from the set or pool and cannot be selected by the central controller upon another wager. The selected game outcome is communicated to the individual gaming device to be utilized in the initiated poker game. In another embodiment, the predetermined game outcome is stored in a memory device of the gaming device. In this embodiment, the gaming device selects a game outcome from a set or pool of stored game outcomes and flags the selected game outcome as used.

In one embodiment, each predetermined game outcome includes an outcome component, such as a win, a lose, a secondary game triggering or other suitable outcome, with an associated value or pay amount, if any. For example, a predetermined game outcome of win $100 is selected. It should be appreciated that the payout or value associated with the selected predetermined game outcome corresponds to or equals the payout or value associated with one of the poker outcomes which may be obtained in a poker game. For example, if a game outcome of win $100 is selected, the gaming device determines that according to an appropriate paytable, a $100 payout is associated with the player obtaining a full house poker hand and thus, as described in more detail below, the gaming device determines that a full house poker hand must be provided to the player in the poker game. In another embodiment, each game outcome also includes a presentation component. A presentation component is how the game outcome is presented or displayed to the player, such as which specific playing cards will form the hand of cards dealt in a card game.

In one embodiment, after obtaining the selected predetermined game outcome, the gaming device initially displays or deals a plurality of individual sets or hands of playing cards. The rank and suit of each playing card is not initially displayed to the player (i.e., each card is initially dealt face down). The gaming device then determines, based on the selected predetermined game outcome, one or more playing cards to display to the player for one or more of the individual hands of playing cards. In an alternative embodiment, the rank and suit of one or more of the playing cards in one or more of the hands of playing cards are initially displayed to the player (i.e., one or more cards are initially dealt face up) wherein each displayed playing card is based on the selected predetermined game outcome. Thus, the gaming device teases or partially reveals one or more playing cards of one or more poker hands to the player prior to enabling the player to decide which poker hand to player.

As described below, the displayed playing cards for each individual poker hand may be part of the poker hand ultimately provided to the player. Accordingly, the displayed playing cards for each individual poker hand must, when combined with one or more subsequently displayed playing cards, form a poker hand which is associated with a payout equal to the payout associated with the selected predetermined game outcome. For example, if the predetermined game outcome is associated with a value that, according to an appropriate paytable, is associated with a full house poker hand and the gaming device displays three playing cards from one of the individual hands of playing cards, the gaming device determines that at least two of the displayed cards must be of the same rank. If three different ranked cards are displayed to the player, a full house poker hand cannot be formed from three different ranked playing cards and thus the selected predetermined game outcome could not be provided to the player. Accordingly, in this example, the gaming device must determine the appropriate playing cards (i.e., at least two same ranked playing cards) to display part of a poker hand that provides the player the selected predetermined game outcome. It should be appreciated that if the gaming device displays one or more cards for a plurality of the poker hands, a separate determination is made for each of the individual poker hands.

In one embodiment, after displaying one or more determined playing cards from one or more of the individual poker hands, the gaming device enables the player to select one of the individual poker hands to play as the player's active poker hand. In this embodiment, the player may select a poker hand with one or more revealed playing cards or the player may select a poker hand without any revealed playing cards. For example, if a partially revealed poker hand displays a pair of jacks, then knowing that a pair of jacks results in a win according to a appropriate paytable, the player may decide to take the poker hand with the revealed pair of jacks. On the other hand, if the partially revealed poker hand displays three unrelated playing cards such as the three of clubs, five of hearts and seven of diamonds, then knowing that the revealed playing cards do not correspond to a win according to the appropriate paytable, the player may decide to select one of the poker hands without any revealed cards.

After the player selects one of the individual poker hands to be actively played, the gaming device determines which playing cards must be provided to the actively played poker hand to provide the player the selected predetermined game outcome. In other words, the gaming device will determine which playing cards to determine and display for the player selected individual poker hand to insure that the player selected individual poker hand is associated with a payout equal to the payout associated with the selected predetermined game outcome. In one embodiment, the gaming device utilizes a look-up table of possible poker hands to determine, based on any previously displayed playing cards for the selected poker hand, which non-displayed playing cards remaining in the deck may be combined with any previously displayed playing cards to form a poker hand which corresponds with the selected predetermined game outcome.

If the player selected a poker hand without any previously displayed playing cards, the gaming device determines a poker hand which is associated with a payout equal to the payout associated with the predetermined game outcome. For example, if the predetermined outcome is associated with a payout equal to a full house and the player selects a poker hand without any previously displayed playing cards, the gaming device determines that to provide the selected poker hand with a full house, any playing card combination which results in a full house may be displayed to the player.

If the player selected a poker hand with at least one previously displayed playing card, the gaming device determines a poker hand which includes the previously displayed playing card(s) and also is associated with a payout equal to the payout associated with the predetermined game outcome. For example, if the predetermined outcome is associated with a payout equal to a full house and the player selects a poker hand which previously displayed a pair of jacks, the gaming device determines that to provide the selected poker hand with a full house, the remaining cards which must be displayed in the selected poker hand are either another jack and a pair of non-jack playing cards or three equally ranked non-jack playing cards.

In one embodiment, in addition to determining which playing cards to display to the player in the actively played hand to guarantee that a poker hand with a payout equal to the selected predetermined game outcome value is provided to the player, the gaming device determines, preferably randomly, one or more playing cards for each of the non-selected hands of playing cards. For each playing card in each non-selected hand that is not yet displayed to the player during a previous reveal sequence, the gaming device determines a playing card and displays the determined playing card to the player. It should be appreciated that in one embodiment, as each non-selected hands of playing cards is randomly selected, one or more of the non-selected hands may be associated with a greater payout than the selected poker hand and one or more of the non-selected hands may be associated with a lesser payout than the selected poker hand. This feature provides increased excitement and entertainment for the player because while regardless of which poker hand the player actively plays the player will obtain a poker hand with a payout equal to the payout associated with the selected predetermined game outcome, the player will view the randomly determined outcomes they think they would have received if they picked a different poker hand to actively play.

Accordingly, one embodiment of the present invention provides a poker game which provides predetermined game outcomes to a player wherein a player is enabled to make one or more choices or decisions during the poker game while the predetermined game outcome is still provided to the player. Additionally, the present invention provides an interactive poker game wherein at least one of the cards of at least one of the poker hands is displayed to the player to tease the player regarding which poker hand to actively play.

In alternative embodiments, the gaming device of the present invention may be employed with other suitable types of poker games, such as Texas Hold'em. In other embodiments, the gaming device of the present invention may be employed with other suitable non-poker cards games, such as blackjack or other suitable games, such as slot games.

Additional features and advantages of the present invention are described in, and will be apparent from, the following Detailed Description of the Invention and the figures.

DETAILED DESCRIPTION OF THE INVENTION

Figure 1A:
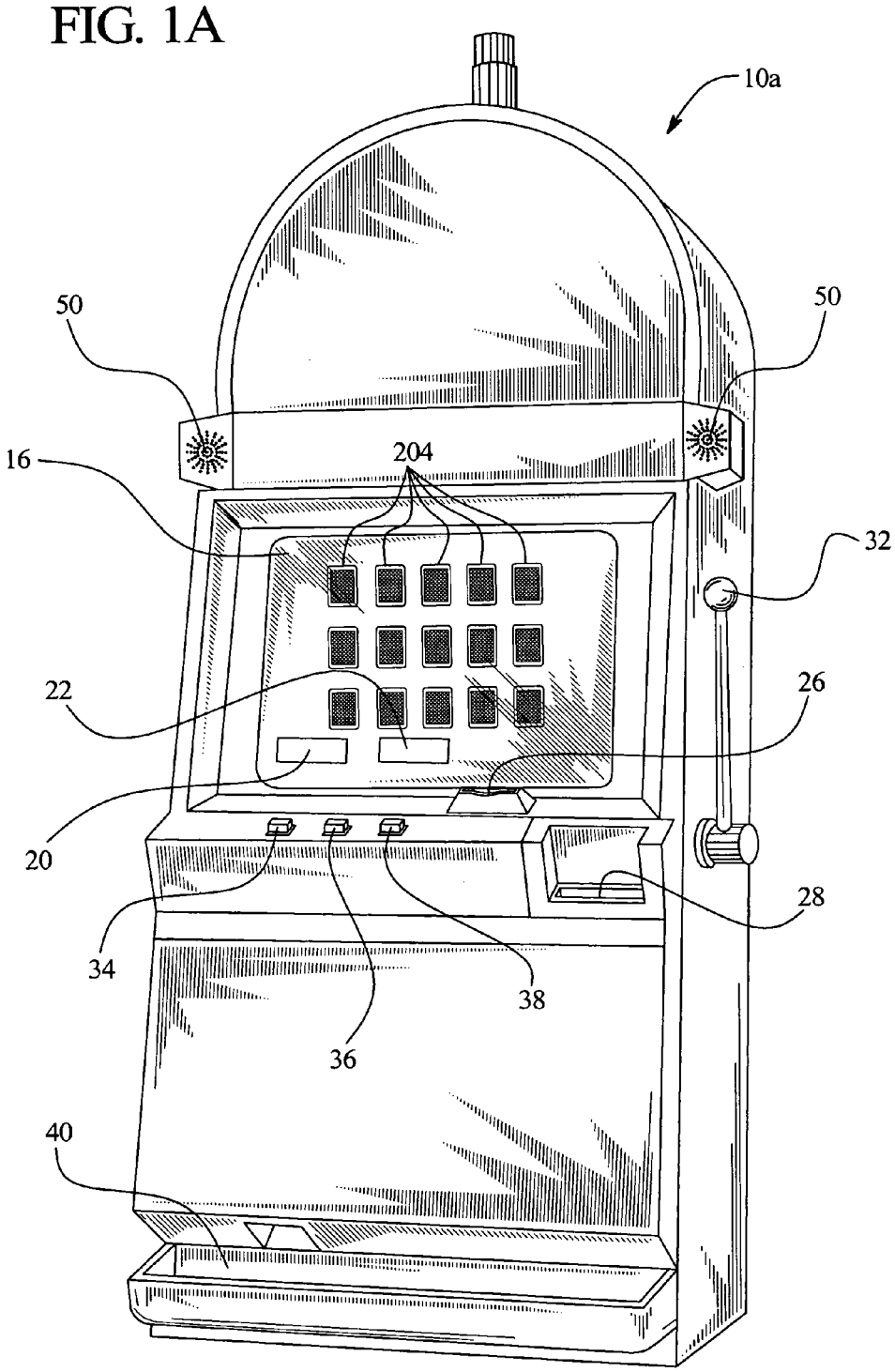
FIGS. 1A and 1B are perspective views of alternative embodiments of the gaming device of the present invention.
Figure 1B:
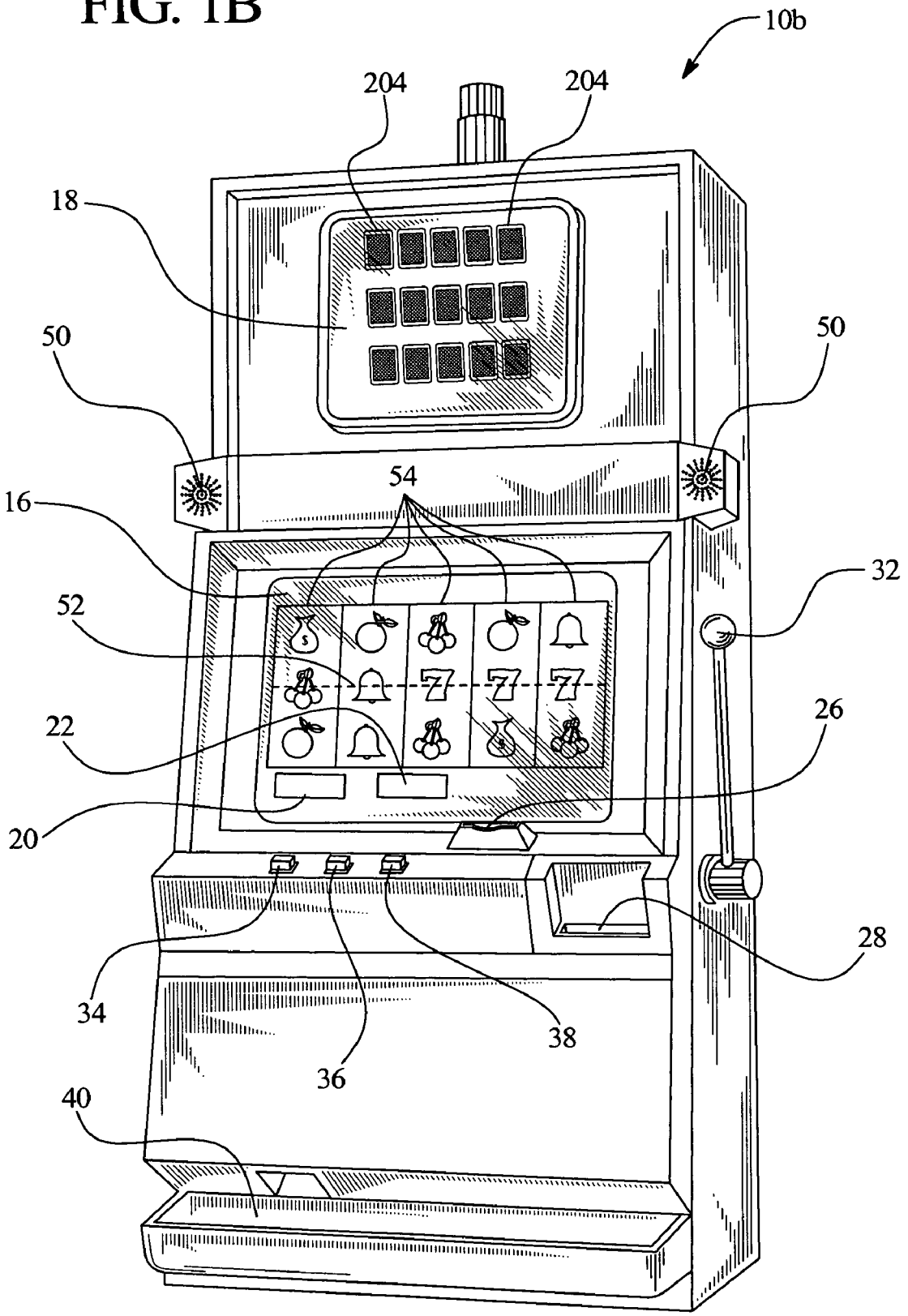

Referring now to the drawings, two alternative embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10.

In one embodiment, as illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device can be constructed with varying cabinet and display configurations.

Figure 2A:
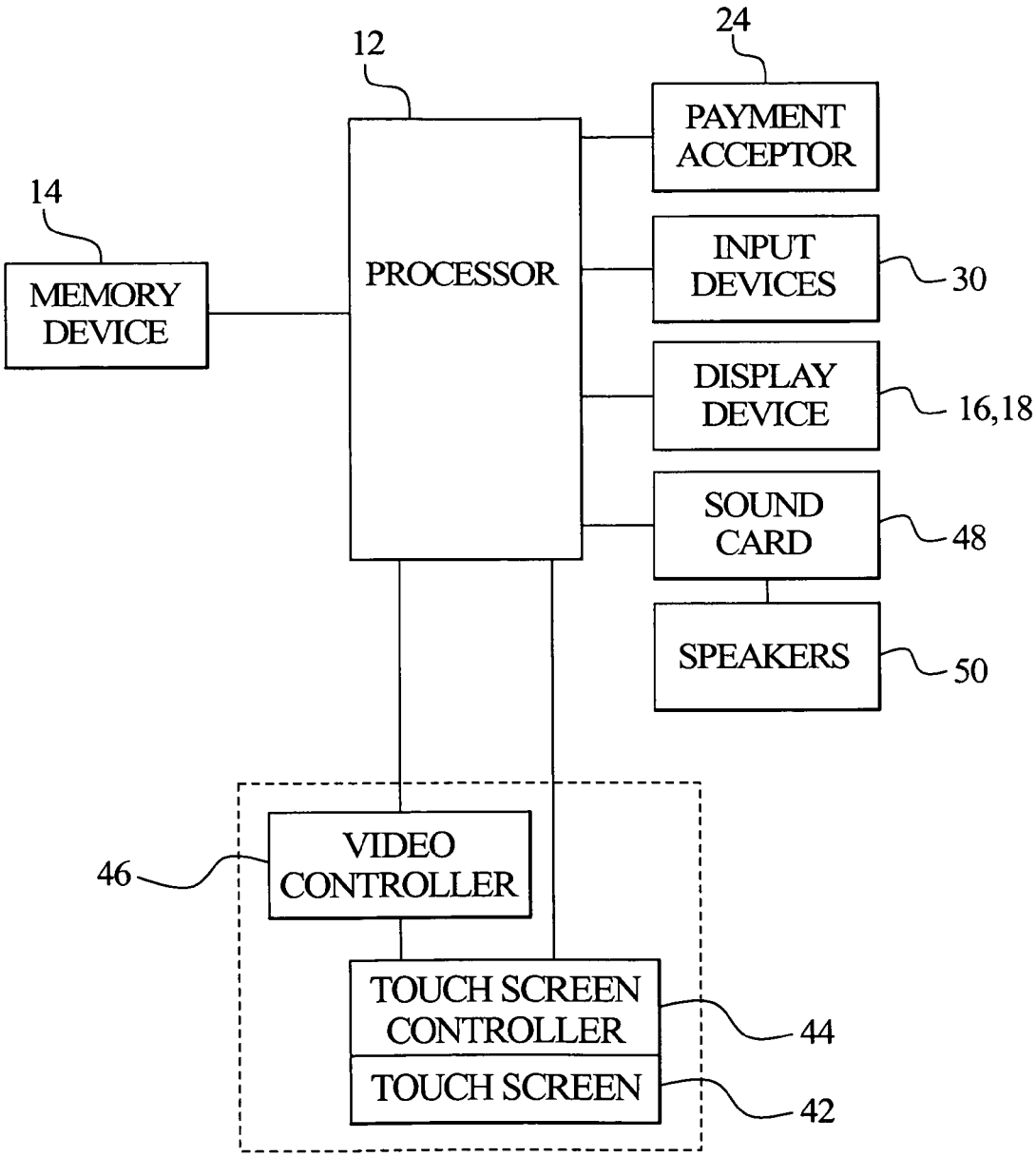
FIG. 2A is a schematic block diagram of an electronic configuration of one embodiment of the gaming terminal of the present invention.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudorandom number generators, pay-table data or information and applicable game rules that relate to the play of the gaming device. In one embodiment, the memory device stores a pool of predetermined outcomes which will be provided to the players during the play of the interactive poker game of the present invention.

In one embodiment, the memory device includes random access memory (RAM). In one embodiment, the memory device includes read only memory (ROM). In one embodiment, the memory device includes flash memory and/or EEPROM (electrically erasable programmable read only memory). Any other suitable magnetic, optical and/or semiconductor memory may be implemented in conjunction with the gaming device of the present invention.

In one embodiment, part or all of the program code and/or operating data described above can be stored in a detachable or removable memory device, including, but not limited to, a suitable cartridge, disk or CD ROM. A player can use such a removable memory device in a desktop, a laptop personal computer, a personal digital assistant (PDA) or other computerized platform. The processor and memory device may be collectively referred to herein as a "computer."

In one embodiment, as discussed in more detail below, the gaming device employs a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. This type of gaming device provides players with all of the available awards or other game outcomes over the course of the play cycle and guarantees the amount of actual wins and losses.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any secondary game associated with the primary game as well as information relating to the primary or secondary game. The alternative embodiment shown in FIG. 1B includes a central display device 16 and an upper display device 18. The upper display device may display the primary game, any suitable secondary game associated with the primary game and/or information relating to the primary or secondary game. In another embodiment, at least one display device may be a mobile display device, such as a PDA or tablet PC, that enables at least a portion of the primary or secondary game to be played at a location remote from the gaming device. As seen in FIGS. 1A and 1B, in one embodiment, the gaming device includes a credit display 20 which displays a player's current number of credits, cash, account balance or the equivalent. In one embodiment, gaming device includes a bet display 22 which displays a player's amount wagered.

The display devices may include, without limitation, a monitor, a television display, a plasma display, a liquid crystal display (LCD) a display based on light emitting diodes (LED) or any other suitable electronic device or display mechanism. In one embodiment, as described in more detail below, the display device includes a touch-screen with an associated touch-screen controller. The display devices may be of any suitable configuration, such as a square, rectangle, elongated rectangle.

The display devices of the gaming device are configured to display at least one and preferably a plurality of playing cards 204, game or other suitable images, symbols and indicia such as any visual representation or exhibition of the movement of objects such as mechanical, virtual or video reels 54, mechanical, virtual or video wheels, dynamic lighting, video images, images of people, characters, places, things and faces of cards, tournament advertisements and the like.

In one alternative embodiment, the symbols, images and indicia displayed on or of the display device may be in mechanical form. The display device may include any electromechanical device, such as one or more mechanical objects, such as one or more rotatable wheels, reels or dice, configured to display at least one and preferably a plurality of game or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, ticket or voucher into the payment, note or bill acceptor. In other embodiments, devices such as readers or validators for credit cards, debit cards or credit slips could be used for accepting payment. In one embodiment, a player may insert an identification card into a card reader of the gaming device. In one embodiment, the identification card is a smart card having a programmed microchip or a magnetic strip coded with a player's identification, credit totals and other relevant information. In one embodiment, money may be transferred to a gaming device through electronic funds transfer. When a player funds the gaming device, the processor determines the amount of funds entered and the corresponding amount is shown on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is read by the processor. In one embodiment, after appropriate funding of the gaming device, the input device is a game activation device, such as a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier or funding to the player's electronically recordable identification card.

In one embodiment, shown in FIG. 1B, the gaming device also includes a plurality of hold/discard buttons 60. The player may designate each of the plurality of playing cards dealt to the player as either a hold or discard by using the hold/discard buttons. In one embodiment, the gaming device includes one hold/discard button for all of the playing cards. In another embodiment, the gaming device includes an individual hold/discard button for each of the dealt playing cards.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching touch-screen at the appropriate places.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera, in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

Figure 2B:
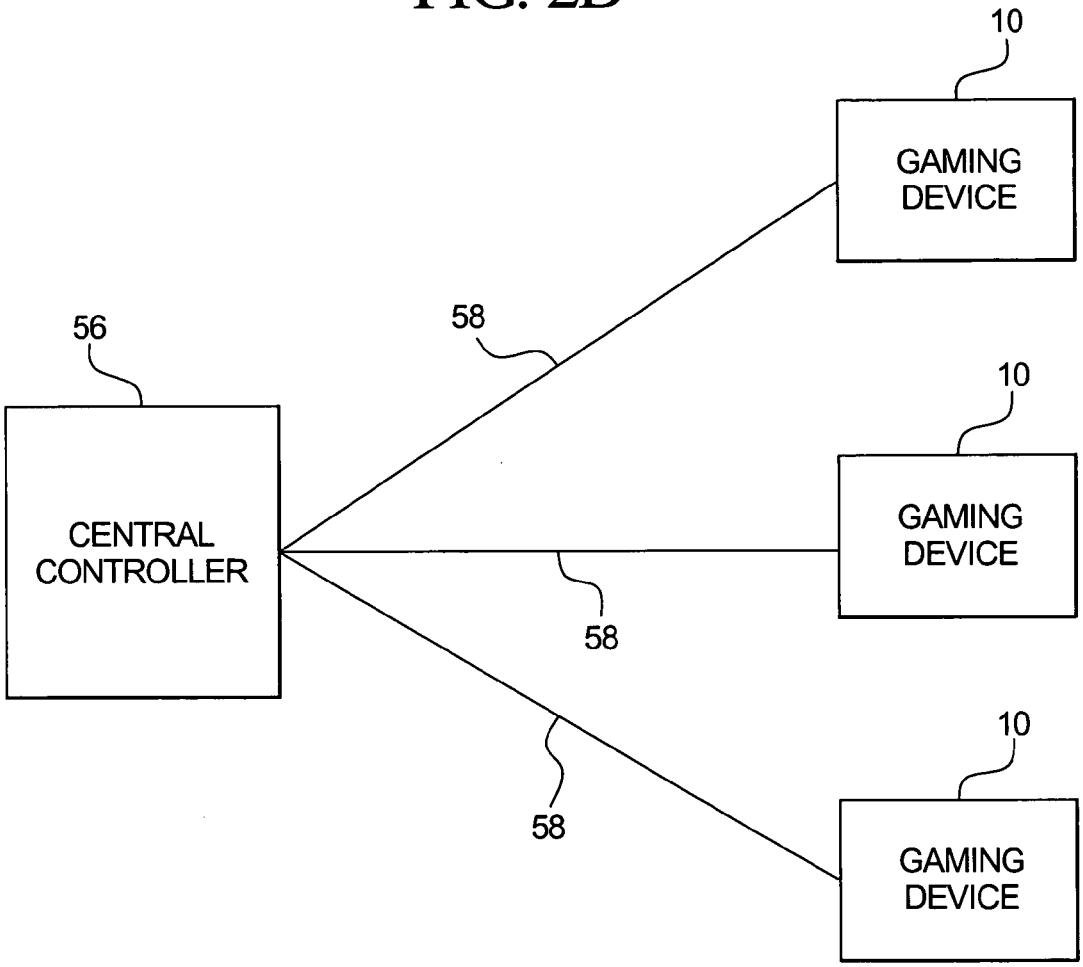
FIG. 2B is a schematic block diagram illustrating a plurality of gaming terminals in communication with a central controller.

In one embodiment, as illustrated in FIG. 2B, one or more of the gaming devices 10 of the present invention may be connected to each other through a data network or a remote communication link 58 with some or all of the functions of each gaming device provided at a central location such as a central server or central controller 56. More specifically, the processor of each gaming device may be designed to facilitate transmission of signals between the individual gaming device and the central server or controller.

In one embodiment, the predetermined game outcome provided to the player is selected by a central server or controller and provided to the player at the gaming device of the present invention. In this embodiment, each of a plurality of such gaming devices are in communication with the central server or controller. Upon a player initiating game play at one of the gaming devices, the initiated gaming device communicates a game outcome request to the central server or controller. Upon receiving the game outcome request, the central controller independently selects a game outcome from a set or pool of game outcomes and flags or marks the selected game outcome as used. Once a game outcome is flagged as used, it is prevented from further selection from the set or pool and cannot be selected by the central controller upon another wager. The selected game outcome is communicated to the individual gaming device to be utilized in the interactive poker game.

In one embodiment, the central controller maintains at least one predetermined set or pool of predetermined game outcomes for each type of game provided on the gaming terminals. In an alternative embodiment, the central controller maintains a plurality of predetermined sets or pools of predetermined game outcomes for each type of provided game. In another embodiment, the central controller maintains a predetermined set or pool of predetermined game outcomes for each denomination of each type of game provided on the gaming terminals. In another embodiment, the central controller maintains at least one predetermined set or pool of predetermined game outcome seeds. Each game outcome seed is deterministic of a predetermined game outcome. Other methods for storing the pool or set of predetermined game outcomes may be employed in accordance with the present invention.

Each predetermined game outcome includes an outcome component, such as a win, a loss, a secondary game triggering or other suitable outcome, with an associated value or pay amount, if any. For example, one game outcome may be a win $5 game outcome and another game outcome may be a loss or $0 game outcome. Each set or pool of predetermined game outcomes may include a plurality of each type of predetermined game outcome. For example, a pool of one thousand game outcomes may include hundreds of a lower range award (i.e., a win $1 game outcome) and one or few of the highest award (i.e., a win $1000 game outcome). In one embodiment, a plurality of the game outcomes in the predetermined set or pool are different. In another embodiment, all of the game outcomes in the set or pool are different.

In one embodiment, each game outcome may also include a presentation component. A presentation component is how the predetermined game outcome is presented or displayed to the player, such as a specific hand of cards dealt. In order to increase player entertainment, a plurality of game outcomes with the same outcome component and associated value have different presentation components. That is, the same win $5 game outcome is presented or displayed to the player in a different way. For example, in a poker style game, each of the same game outcomes are displayed or presented to the player as a different hand of cards.

In one embodiment, all of the gaming terminals which are coupled to the central processor are configured to play the same type of game. In an alternative embodiment, a plurality of the gaming terminals are configured so that different gaming terminals may be used to play different types of games. For example, some gaming terminals may be used for playing a slot machine style game, others may be used for playing a poker style game, others may be used for playing a blackjack style game, and the like. In another embodiment, a plurality of gaming terminals may each be configured for playing a plurality of different games.

In another embodiment, one or more of the gaming devices of the present invention are in communication with a central server or controller for monitoring purposes only. In this embodiment, each gaming device stores a pool of predetermined outcomes to be provided to the player in a memory and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, one or more of the gaming devices of the present invention are connected together through a data network. In another embodiment, one or more of the gaming devices of the present invention are connected to the central controller through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system of the present invention may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital signal line (DSL), T-1 line, coaxial cable, fiber optic cable, or other suitable connection. In this embodiment, players may access an internet game page from any location where an internet connection and computer, or other internet facilitator are available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications according to the present invention, particularly if such communications are encrypted. Higher data transmission speeds may be useful for enhancing the sophistication and response of the display and interaction with the player.

In another embodiment, a plurality of gaming devices at one or more gaming sites may be networked to a central server and operable to provide one or more progressive awards to one or more players. A progressive award is an award amount which includes an initial amount funded by a casino and an additional amount funded through a portion of each wager made on the progressive gaming device. For example, 1% of each wager on the primary game of the gaming device may be allocated to the progressive award or progressive award fund. The progressive award grows in value as more players play the gaming device and more portions of the players' wagers are allocated to the progressive award. When a player obtains a winning outcome which results in or is associated with the progressive award, the accumulated progressive award is provided to the player. After the progressive award is provided to the player, the amount of the next progressive award is reset to the initial value and a portion of each subsequent wager is allocated to the next progressive award as described above. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between the gaming device hardware and software and the host site computer.

In one embodiment, the interactive game of the present invention may be employed as either a primary game or a base game. If the interactive game is implemented as a secondary game, then the gaming device can incorporate any suitable wagering primary or base game. The gaming machine or device of the present invention may include some or all of the features of conventional gaming machines or devices. The primary or base interactive game may comprise any suitable reel-type game, card game, number game or other game of chance susceptible to representation in an electronic or electromechanical form which produces a predetermined outcome upon activation from a wager. Different primary wagering games, such as video poker games, video blackjack games, video Keno, video bingo or any other suitable primary or base game may be implemented into the present invention.

In another embodiment, if the interactive game is implemented as a primary game, then in addition to winning credits in the primary interactive game, the gaming device may also give players the opportunity to win credits in a bonus or secondary game or bonus or secondary round. The bonus or secondary game enables the player to obtain a prize or payout in addition to the prize or payout, if any, obtained from the base or primary game.

In one embodiment, the bonus or secondary game may be any type of suitable game, either similar to or completely different from the base or primary game. In one embodiment, the bonus game is one or more hands of an interactive poker game. In another embodiment, the bonus game is a plurality of simultaneously played hands of an interactive poker game. In one embodiment, the gaming device includes a program which will automatically begin a bonus round when the player has achieved a triggering event or qualifying condition in the base or primary game. In one embodiment, the triggering event or qualifying condition may be a selected outcome in the primary game or a particular arrangement of one or more indicia on a display device in the primary game. In another embodiment, the triggering event or qualifying condition may be by exceeding a certain amount of game play (number of games, number of credits, amount of time), reaching a specified number of points earned during game play or as a random award.

In one embodiment, once a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or geometric increase in the number of bonus wagering credits awarded. In one embodiment, extra bonus wagering credits may be redeemed during the bonus game to extend play of the bonus game.

It should be appreciated that if the gaming device enables the player to play a secondary game in addition to the interactive game, then regardless of how the game outcome is ultimately provided to the player, either as a value or payout from the primary or base game, as a value or payout from the secondary or bonus game, as a loss from the primary or base game or as a loss from the secondary or bonus game, the game outcome is predetermined. That is, if the predetermined game outcome is a win outcome and the value or payout provided in the primary or base game do not reach the value or payout associated with the predetermined game outcome, then the gaming device utilizes the secondary or bonus game to supplement any value or payout provided in the base game to sum the total value or payout from the primary and secondary game to the value or payout associated with the predetermined game outcome. For example, if the particular game outcome associated with the player's choice or decision is a win outcome with an associated value or payout of $10, the outcome may be presented to the player as a $10 win outcome in the primary or base game, a $10 secondary or bonus game win outcome or any combination of payouts in the primary or base game and secondary or bonus game that result in a total payout of $10. Either way, the player is provided $10 and that particular game outcome is removed from the set of game outcomes.

Figure 3:
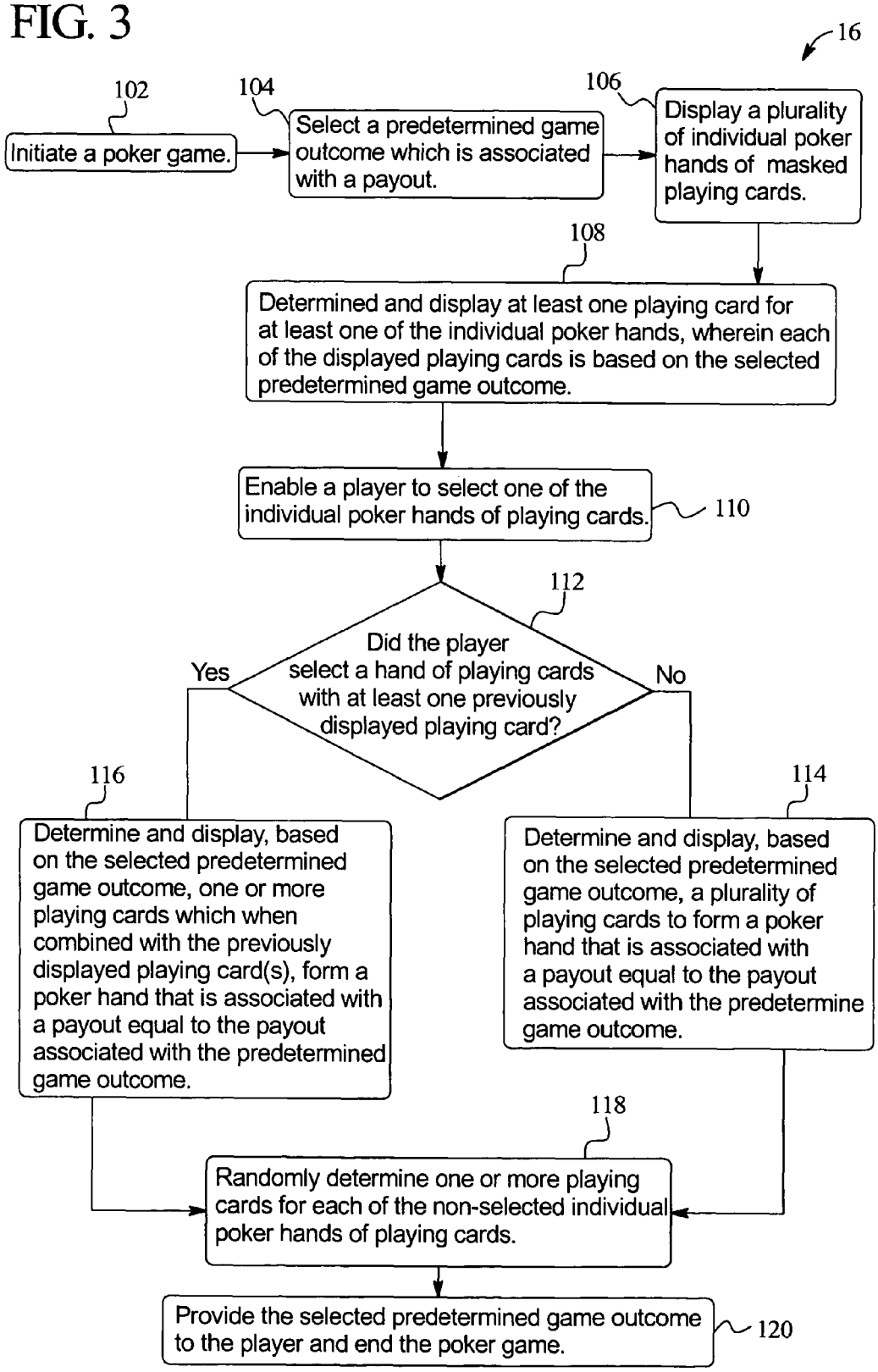
FIG. 3 is a schematic block diagram illustrating one embodiment of the present invention wherein a predetermined game outcome is selected and the player plays an interactive poker game wherein the selected predetermined game outcome is provided to the player.

Referring to FIG. 3, the game play of an interactive game of the present invention, such as an interactive poker game is initiated by a player inserting the appropriate amount of money or tokens at the gaming device as indicated in block 102. After the interactive poker game is initiated, a predetermined outcome is selected as indicated in block 104.

In one embodiment, the gaming device selects one of the predetermined game outcomes stored in a memory device of the gaming device. In another embodiment, as described above, the gaming device is in communication with the central controller and the central controller selects a predetermined game outcome. The central controller then flags the selected game outcome as used (i.e., preventing the selected game outcome from being subsequently selected by the central controller) and communicates the predetermined game outcome to the gaming device.

In another embodiment, a predetermined game outcome is determined for each of a plurality of linked or networked gaming devices based on the results of a multi-gaming device Bingo game. In this embodiment, each individual gaming device utilizes the game outcome provided to that gaming device in a Bingo game as the predetermined game outcome for a displayed poker game at that gaming device. In one embodiment, the game outcomes determined in the Bingo game are utilized in the poker game and the Bingo game is displayed to the player.

In these embodiments, as each gaming device is enrolled in the Bingo game, such as upon an appropriate wager or engaging an input device, the enrolled gaming device is provided a different Bingo card. Each Bingo card consists of a matrix or array of elements, wherein each element is designated with a separate indicia, such as a number. It should be appreciated that each different Bingo card includes a different combination of elements. For example, if four Bingo cards are provided to four enrolled gaming devices, the same element may be present on all four of the Bingo cards while another element may solely be present on one of the Bingo cards.

In operation of this embodiment, upon providing a different Bingo card to each of a plurality of enrolled gaming devices, the central controller randomly selects or draws, one at a time, a plurality of the elements. As each element is selected, each gaming device determines if the selected element is present on the Bingo card provided to that enrolled gaming device. If the selected element is present on the Bingo card provided to that enrolled gaming device, that gaming device marks or flags the selected element on the provided Bingo card. This process of selecting elements and marking any selected elements on the provided Bingo cards continues until one or more predetermined patterns are marked on one or more of the provided Bingo cards. It should be appreciated that in one embodiment, the gaming device requires the player to engage a "daub" button (not shown), in order to initiate the process of the gaming device marking or flagging any selected elements.

After one or more predetermined patterns are marked on one or more of the provided Bingo cards, a game outcome is determined for each of the enrolled gaming devices based, at least in part, on the selected elements on the provided Bingo cards. As described above, the game outcome each gaming device determines for the Bingo game is utilized by that gaming device as the predetermined game outcome provided to the player in the displayed poker game. For example, a first gaming device to mark selected elements in a predetermined pattern is provided a first outcome of win $10 which will be provided to the player in the poker game regardless of how the player plays the provided initial poker hand and a second gaming device to mark selected elements in a different predetermined pattern is provided a second outcome of win $2 which will be provided to the player in the poker game regardless of how the player plays the provided initial poker hand. It should be appreciated that as the process of marking selected elements continues until one or more predetermined patterns are marked, this embodiment insures that at least one Bingo card will win the Bingo game and thus at least one enrolled gaming device will provide a predetermined winning game outcome to a player in at least one poker game.

After selecting, receiving or determining the predetermined game outcome, the gaming device displays a plurality of individual poker hands of masked playing cards as indicated in block 106. In one embodiment, the gaming device only displays to the player an image of the playing cards dealt without providing any playing cards to the plurality of individual poker hands. It should be appreciated that in this embodiment, no playing cards are initially dealt to any of the individual poker hands, but rather, the gaming device merely displays an image of a plurality of face down cards which are apparently initially dealt.

In one embodiment, the number of displayed individual poker hands is predetermined. In another embodiment, the number of displayed individual poker hands is randomly determined. In another embodiment, the number of displayed individual poker hands is based on the player's wager. In one embodiment, the larger the player's wager, the more displayed individual poker hands. In this embodiment, the player may perceive that the larger the player's initial wager, the more displayed poker hands the player may select from to play as their active poker hand. In another embodiment, the larger the player's initial wager, the less displayed individual poker hands. It should be appreciated that any suitable method of determining the number of displayed individual poker hands may be employed in accordance with the present invention.

In one embodiment, the number of playing cards in each individual poker hand is the same. In another embodiment, the number of playing cards in a plurality of the individual poker hands is different. In another embodiment, the number of playing cards in each individual poker hand is different. In different embodiments, the number of playing cards in the individual poker hands is predetermined, randomly determined, determined based on the player's wager, determined based on play of a sub-game or determined based on any other suitable manner. It should be appreciated that in different embodiments wherein the number of cards in each hand are different, any paytable is appropriately adjusted for the different numbers of cards.

In one embodiment, the gaming device initially displays a partial poker hand for one or more of the individual poker hands. For example, in a five card poker game, the gaming device may initially display (or display an image of a dealt, face down playing card) three playing cards for one or more of the individual poker hands. It should be appreciated that in this embodiment, as the game progresses, the gaming device subsequently provides each individual partial poker hand with the number of cards necessary to form a complete individual poker hand. In another embodiment, the gaming device initially displays a complete or full poker hand for one or more of the individual poker hands.

After displaying a plurality of individual poker hands, the gaming device determines and displays at least one playing card for at least one of the individual poker hands as indicated in block 108. Each of the displayed playing cards is based on the selected predetermined game outcome. Since the displayed playing cards may be part of the poker hand selected by the player (i.e., the poker hand which any award or payout is determined based on), the displayed playing cards must, when combined with one or more subsequently determined and displayed playing cards, form a poker hand which, with reference to an appropriate paytable, is associated with a payout equal to the payout associated with the selected predetermined game outcome. It should be appreciated that if the selected predetermined game outcome is provided to the player as a combination of the payouts from one or more primary games and one or more secondary games, then in the interactive poker game, the gaming device provides the player a portion of the payout of the selected predetermined game outcome allocated for the interactive poker game.

In one embodiment, upon selecting the predetermined game outcome, the gaming device determines according to an appropriate paytable which possible poker hands are associated with payouts that equal the payout associated with the selected game outcome. In this embodiment, the gaming device then displays one or more of the playing cards of one or more of the determined possible poker hands to the player for one or more of the individual poker hands. It should be appreciated that if the gaming device displays one or more cards for a plurality of the poker hands, a separate determination is made for each of the individual poker hands.

In one embodiment, at least one individual poker hand displays one or more playing cards. In another embodiment, a plurality of individual poker hands each display one or more playing cards. In another embodiment, each of the individual poker hands display one or more playing cards. In another embodiment, the gaming device enables a player to pick or select one or more of the individual poker hands wherein the player picked poker hands display one or more playing cards. In different embodiments, the number of individual poker hands which display one or more playing card is predetermined, randomly determined, determined based on the player's wager or determined based on any other suitable manner. It should be appreciated that regardless of how many playing cards each individual poker hand displays, each playing card for each poker hand is based on the selected predetermined outcome as described above.

In one embodiment, the playing cards for each individual poker hand are determined and displayed from a single fifty-two card deck. In another embodiment, the playing cards for each individual poker hand are determined and displayed from a plurality of fifty-two card decks. In another embodiment, the playing cards for each individual poker hand are selected from a predetermined number of cards. In another embodiment, the playing cards for each individual poker hand are selected from a deck of more than fifty-two playing cards, such as a deck including one or more "joker" or wild playing cards. In this embodiment, a joker or wild playing card may substitute for any other playing card.

After displaying one or more determined playing cards from one or more of the individual poker hands, the gaming device enables the player to select one of the individual poker hands to play as the player's active poker hand as indicated in block 110. In this embodiment, the player may select a poker hand with one or more revealed playing cards or the player may select a poker hand without any revealed playing cards. For example, if a partially revealed poker hand displays a pair of aces, then knowing that a pair of aces results in a win according to the appropriate paytable, the player may decide to take the poker hand with the revealed pair of aces. On the other hand, if the partially revealed poker hand displays two different ranked, different suited playing cards, then knowing that the revealed playing cards do not correspond to a win according to the appropriate paytable, the player may decide to select one of the poker hands without any revealed cards. As described below, regardless of which individual poker hand the player selects to play as an active hand, the gaming device will determine and display the player selected poker hand with the appropriate playing cards to form a poker hand with a payout equal to the predetermined game outcome.

After the player selects one of the individual poker hands to be actively played, the gaming device determines if the player selected a poker hand with at least one previously displayed playing card as indicated in diamond 112.

If the player selected a poker hand without any previously displayed playing cards, the gaming device determines and displays a plurality of playing cards to form a poker hand that is associated with a payout equal to the payout associated with the predetermined game outcome as indicated in block 114. Each of the determined and displayed playing cards is based on the selected predetermined game outcome. In other words, the gaming device will determine which playing cards to determine and display for the player selected individual poker hand to insure that the player selected individual poker hand is associated with a payout equal to the payout associated with the selected predetermined game outcome. In one embodiment, the gaming device utilizes a look-up table of possible poker hands to determine which poker hand to determine and display for the player selected individual poker hand. A look-up table is a table with all of the possible different poker hands possible and the associated payouts associated with each. In this embodiment, the gaming device scrolls through all the possible poker hands with a payout equal to the selected predetermined game outcome and randomly selects one of the possible poker hands with a payout equal to the selected predetermined game outcome. For example, if the predetermined outcome is associated with a payout equal to a flush, the gaming device determines that to provide the selected poker hand with a flush, any playing card combination which results in a flush may be determined and displayed to the player.

On the other hand, if the player selected a poker hand with at least one previously displayed playing card, the gaming device determines and displays at least one playing card which, when combined with the previously displayed playing card(s), form a poker hand that is associated with a payout equal to the payout associated with the predetermined game outcome as indicated in block 116. Each of the determined and displayed playing cards is based on the selected predetermined game outcome. In other words, the gaming device will determine which playing cards that when combined with any previously displayed playing cards for the player selected individual poker hand to determine and display for the player selected individual poker hand in order to insure that the player selected individual poker hand is associated with a payout equal to the payout associated with the selected predetermined game outcome. For example, if the predetermined outcome is associated with a payout equal to a flush and the player selects a poker hand which previously displayed a jack of clubs, the gaming device determines that to provide the selected poker hand with a flush, the remaining cards which must be displayed in the selected poker hand must all be suited as clubs. It should be appreciated that if the player selected a poker hand with each playing card previously displayed, the gaming device does not display any additional cards for the selected individual poker hand because the previously displayed playing cards form a poker hand which is associated with a payout equal to the predetermined game outcome.

In addition to determining the appropriate playing cards to display to the player to form a poker hand that corresponds with the predetermined game outcome value, the gaming device determines, preferably randomly, one or more playing cards for each of the non-selected hands of playing cards as indicated in block 118. For each playing card in each non-selected hand that is not yet displayed to the player during a previous reveal sequence, the gaming device determines a playing card and displays the determined playing card to the player. In different embodiments, the random determination and display for each non-displayed card in the non-selected poker hands occurs simultaneously, sequentially or in an overlapping manner to the determination and display of the non-displayed card in the selected poker hand. It should be appreciated that as each non-selected hands of playing cards is randomly selected, one or more of the non-selected hands may be associated with a greater payout than the selected poker hand and one or more of the non-selected hands may be associated with a lesser payout than the selected poker hand.

After randomly determining and displaying playing cards for the non-player selected poker hands, the gaming device provides the selected predetermined game outcome to the player and ends the poker game as indicated in block 120. It should be appreciated that as described above, the provided payout associated with the player selected poker hand equals the payout associated with the selected game outcome.

In one embodiment, for one or more of the non-selected poker hands, the gaming device displays playing cards which form a poker hand that corresponds to a greater payout than the payout provided to the player for the selected poker hand. In another embodiment, for one or more of the non-selected poker hands, the gaming device displays playing cards which form a poker hand that corresponds to a lesser payout than the payout provided to the player for the selected poker hand. In different embodiments, the determination of whether to provide a higher or lower payout for one or more of the non-selected poker hands is predetermined, randomly determined, determined based on the player's wager, determined based on play of a sub-game or determined based on any other suitable manner.

Figure 4A:
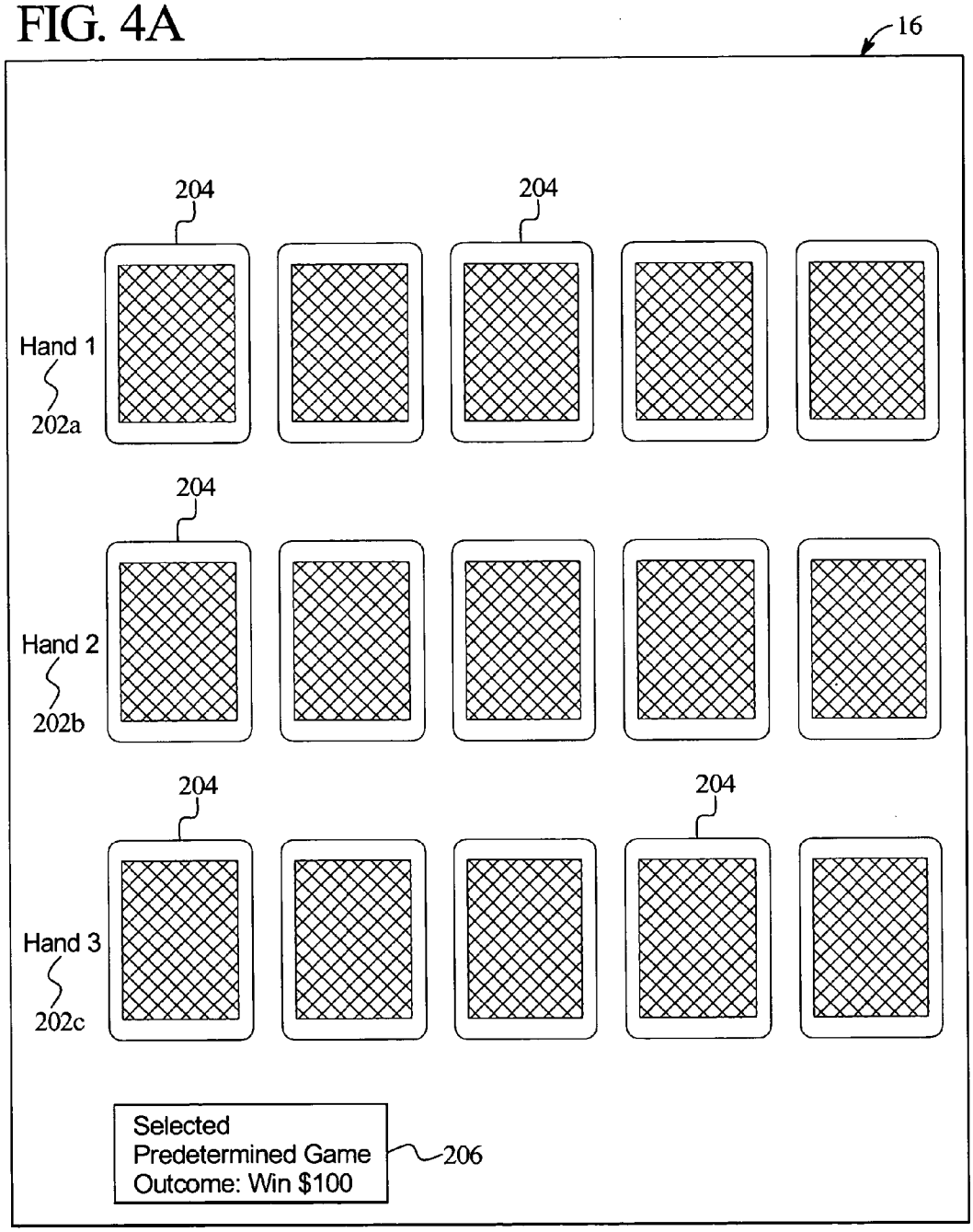
FIGS. 4A, 4B, 4C, 4D, 4E and 4F are top plan views of one embodiment of the present invention illustrating one interactive poker game sequence of the present invention.

Referring now to FIGS. 4A to 4F, in one embodiment of the present invention, the gaming device provides a screen or display 16 wherein the player will play an interactive poker game. As seen in FIG. 4A, upon the initiation of the poker game, a predetermined outcome 206 of win $100 is selected. With reference to an appropriate paytable (not shown), the selected predetermined game outcome of win $100 corresponds to the payout associated with a full house. It should be appreciated that during game play the selected predetermined outcome is not displayed to the player but is only displayed here for illustration purposes.

In addition to obtaining the selected predetermined game outcome, the gaming initially displays or deals a number of individual pluralities or hands of playing cards. Each hand includes a plurality of playing cards 204. The rank and suit of each playing card is not initially displayed to the player (i.e., each card is initially dealt face down). In this example, the gaming device displayed three individual sets of playing cards, Hand One, Hand Two and Hand Three, 202*a*, 202*b* and 202*c*, respectively. It should be appreciated that each individual hand of playing cards is independent of the other hands of playing cards.

Figure 4B:
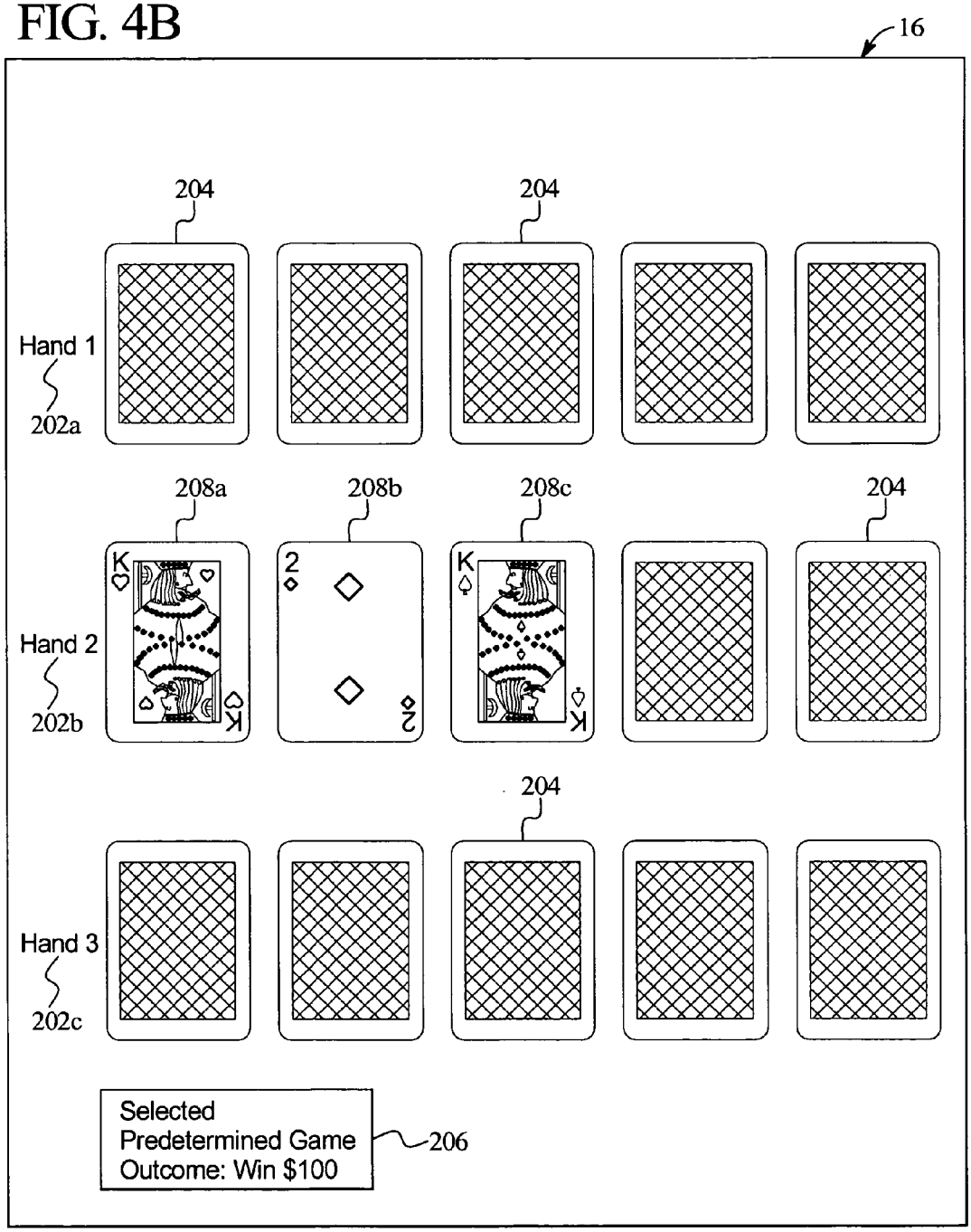

As illustrated in FIG. 4B, after the predetermined outcome is selected and a plurality of individual hands of face down playing cards are displayed, the gaming device determines and displays, based on the selected predetermined game outcome, at least one playing card from at least one of the individual poker hands. In one embodiment, the gaming device determines, according to an appropriate paytable, which possible poker hands are associated with payouts that equal the payout associated with the selected game outcome. In this embodiment, the gaming device then determines and displays one or more of the playing cards of one or more of the determined possible poker hands to the player for one of more of the individual poker hands. In this example, the gaming device displayed the three playing cards of the king of hearts 208*a*, the two of diamonds 208*b* and the king of spades 208*c* for Hand Two. It should be appreciated that the three displayed playing cards, when combined with two additional playing cards, can form a full house poker hand which is associated with a payout equal to the predetermined game outcome.

Figure 4C:
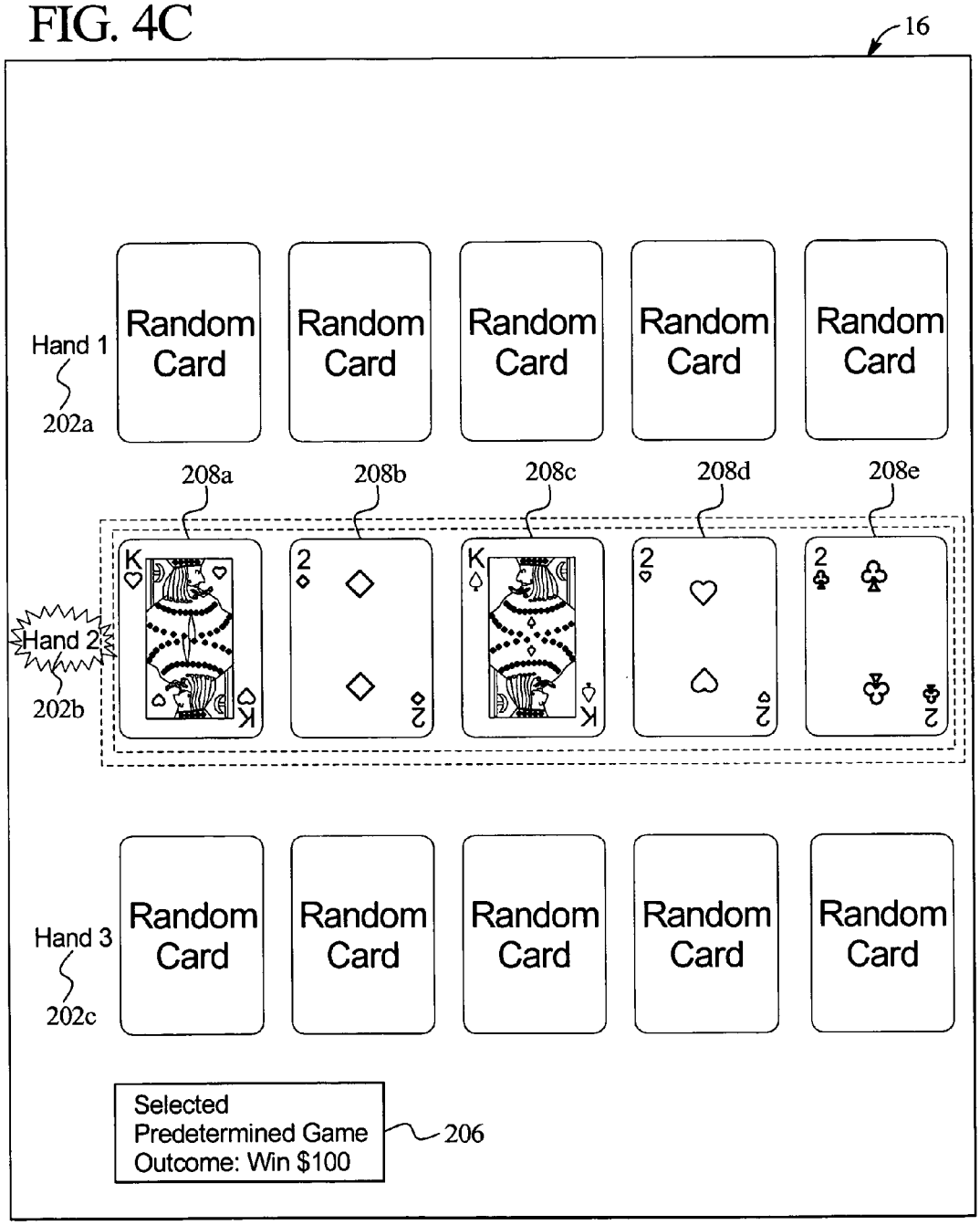

As illustrated in FIG. 4C, after displaying one or more cards to the player for one or more of the individual poker hands, the gaming device enables the player to select one of the individual poker hands to play as the player's active poker hand. Knowing that a pair of kings results in a win according to the appropriate paytable, the player may decide to take the poker hand with the revealed pair of kings and be assured of a winning poker hand. In this example, the player selected Hand Two 202*b*.

After the player selects a hand of playing cards to play, the gaming device determines, based on the selected predetermined game outcome and the previously displayed playing cards for Hand Two, which two additional playing cards will result in a full house poker hand for Hand Two (and thus a payout equal to the payout of the selected predetermined game outcome). In this example, the gaming device determined that a full house poker hand may be provided to the player by either providing an additional king playing card and an additional "two" playing card or by providing two additional "two" playing cards. Accordingly, the gaming device selects the appropriate playing cards, as illustrated in FIG. 4C, of a two of hearts 208*d* and a two of clubs 208*e* and displays the appropriate playing cards to the player. As described above, the player selected poker hand is, according to an appropriate paytable, associated with an payout or outcome equal to the selected predetermined game outcome.

Figure 4D:
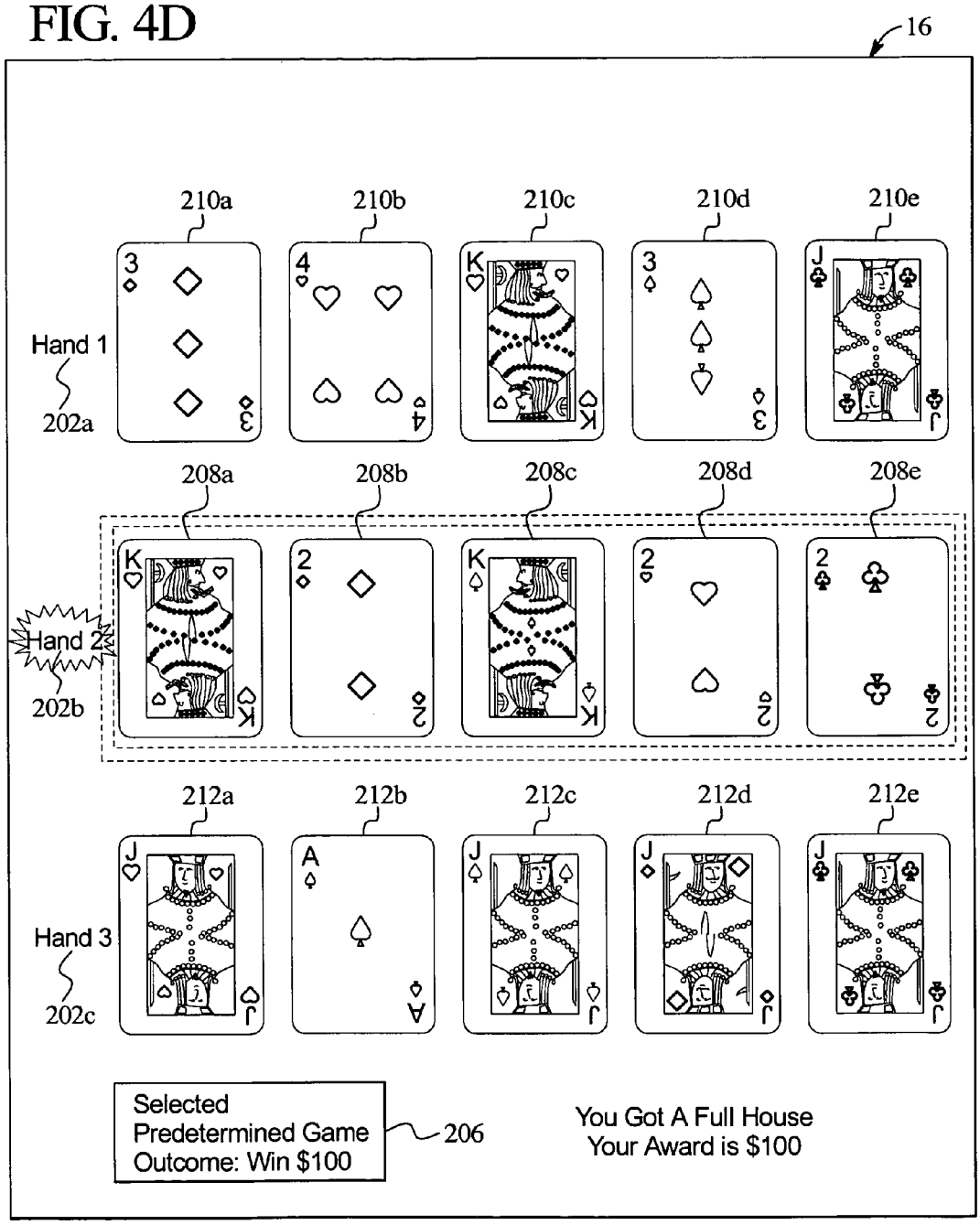

As illustrated in FIGS. 4C and 4D, in addition to providing the player selected poker hand with one or more playing cards based on the selected predetermined game outcome, the gaming device determines, preferably randomly, one or more playing cards for each of the non-selected hands of playing cards. As illustrated in FIG. 4D, for the non-selected Hand One, the gaming device randomly determined and displayed the playing cards of the three of diamonds 210*a*, four of hearts 210*b*, king of hearts 210*c*, three of spades 210*d* and jack of clubs 210*e*. For the non-selected Hand Three, the gaming device randomly determined and displayed the playing cards of the jack of hearts 212*a*, ace of spades 212*b*, jack of spades 212*c*, jack of diamonds 212*d* and the jack of clubs 212*e*. As illustrated in FIG. 4D, the gaming device randomly determined and displayed a non-winning poker hand for non-selected Hand One and a winning poker hand of four jacks for non-selected Hand Three. It should be appreciated that as each individual hand of cards is independent from the other hands of cards and utilizes a separate deck of playing cards, one or more playing cards may be dealt to a plurality of the hands of cards. In this example, the king of hearts playing card was displayed for both Hand One and Hand Two and the jack of clubs playing card was displayed for both Hand One and Hand Three.

After displaying the randomly determined cards for the non-selected poker hands, the player is provided an outcome based on the playing cards of the selected hand of playing cards, in this example, an award of $100. Appropriate messages such as "YOU GOT A FULL HOUSE" and "YOU WON $100" may provided to the player visually, or through suitable audio or audiovisual displays.

Figure 4E:
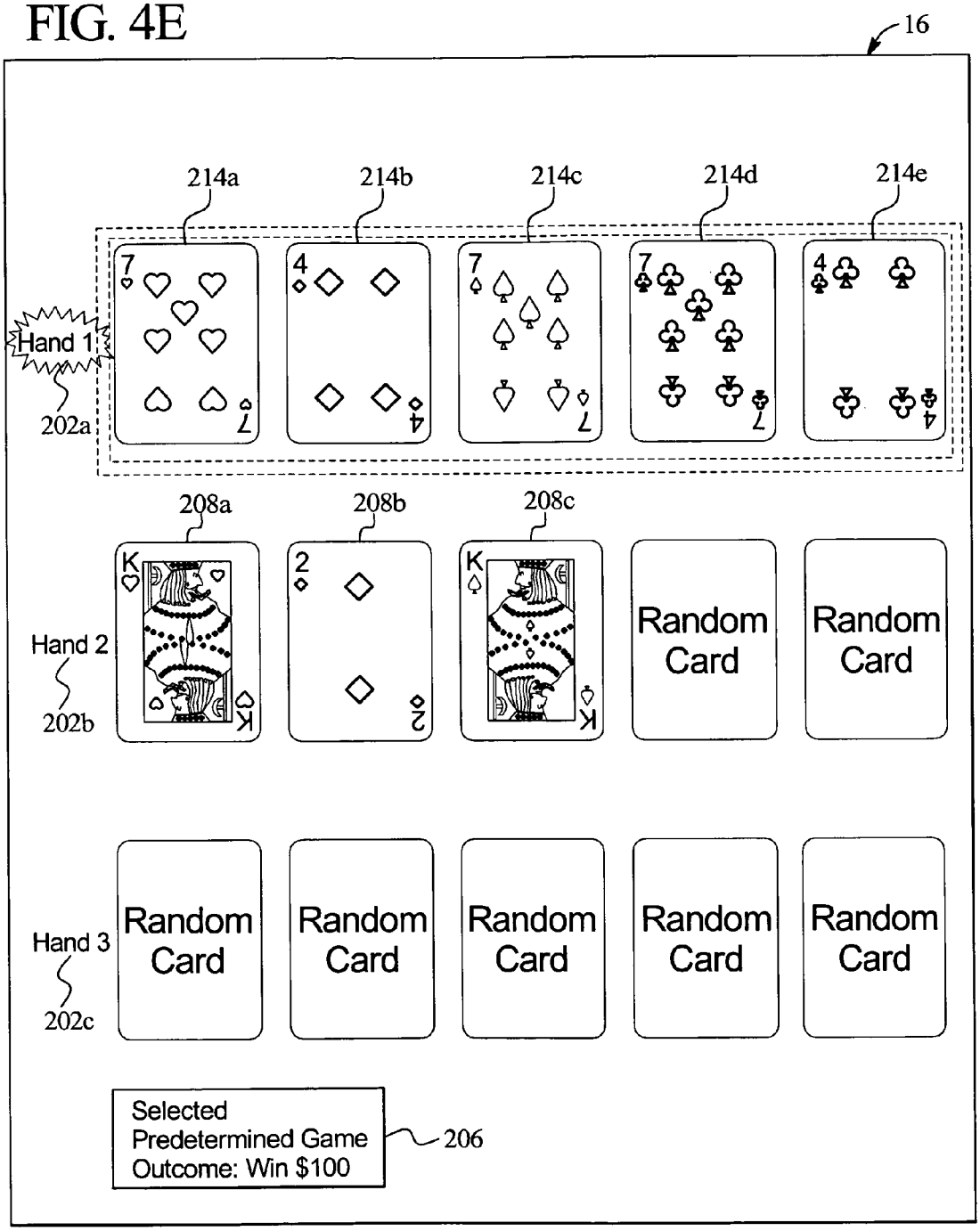

As illustrated in FIG. 4E, if the player alternatively selected to play Hand One as their active hand of playing cards rather than Hand Two, then as described above, the gaming device determines, based on the selected predetermined game outcome which five playing cards will result in a full house poker hand for Hand One (and thus a payout equal to the payout of the selected predetermined game outcome). In this embodiment, the gaming device utilizes a look-up table of possible poker hands (not shown) to determine which combination of playing cards with a payout equal to the selected predetermined game outcome to display for the player selected individual poker hand. In this example, for selected Hand One the gaming device determines and displays the playing cards of the seven of hearts 214*a*, four of diamonds 214*b*, seven of spades 214*c*, seven of clubs 214*d* and four of clubs 214*e*. As described above, the player selected poker hand is, according to an appropriate paytable, associated with an payout or outcome equal to the selected predetermined game outcome.

Figure 4F:
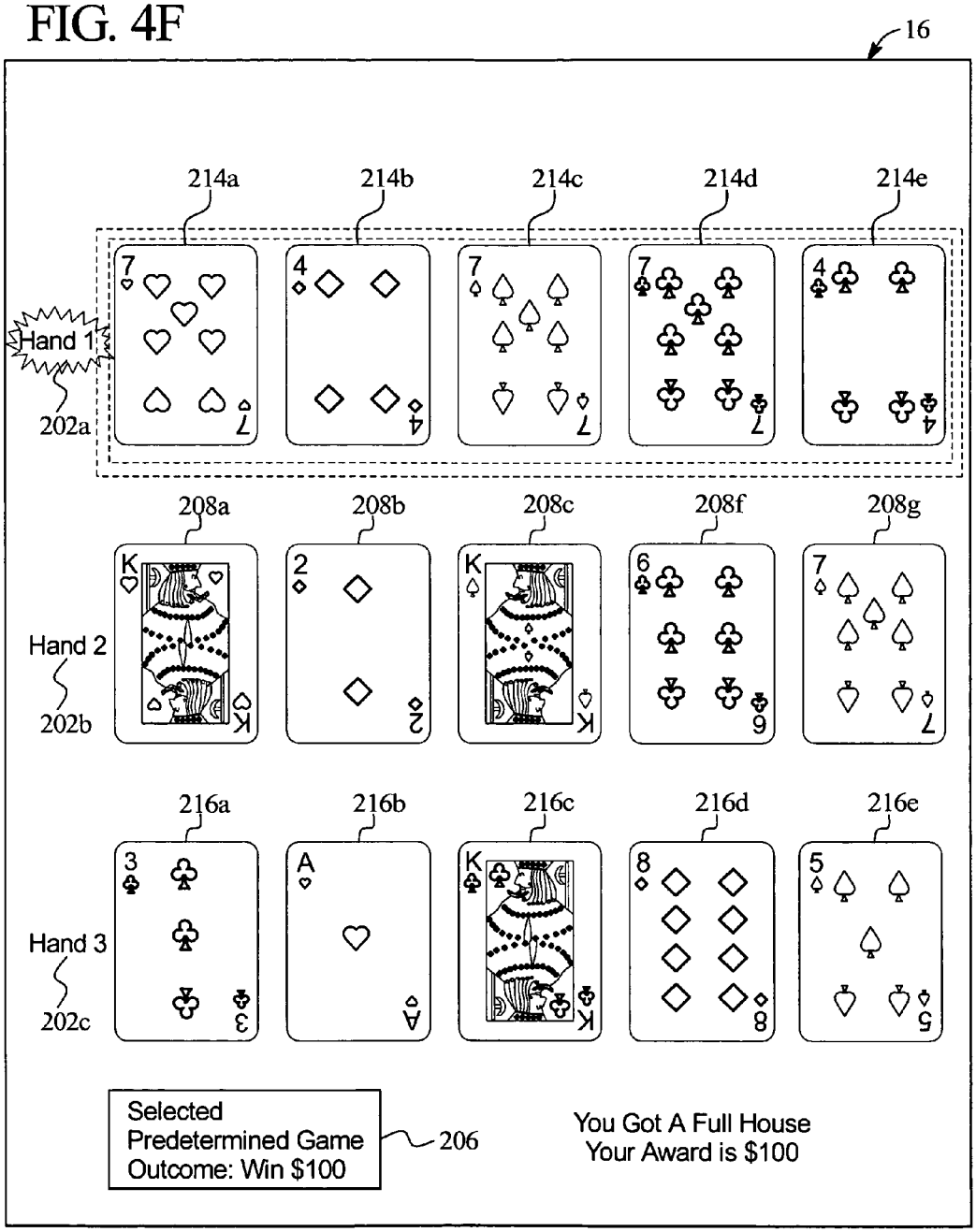

As illustrated in FIGS. 4E and 4F, as described above, the gaming device determines, preferably randomly, one or more playing cards for each of the non-selected hands of playing cards. Accordingly, for the non-selected Hand Two, the gaming device randomly determined and displayed the playing cards of the six of clubs 108*f* and the seven of spades 108*g* in addition to the previously displayed playing cards for Hand Two. For the non-selected Hand Three, the gaming device randomly determined and displayed the playing cards of the three of clubs 216*a*, ace of hearts 216*b*, king of clubs 216*c*, eight of diamonds 216*d* and the five of spades 216*e*. As illustrated in FIG. 4F, the gaming device randomly determined and displayed non-winning poker hands for non-selected Hand One and non-selected Hand Three.

The player is provided an outcome based on the playing cards of the selected hand of playing cards, in this case, an award of $100. Appropriate messages such as "YOU GOT A FULL HOUSE" and "YOU WON $100" may provided to the player visually, or through suitable audio or audiovisual displays. It should be appreciated that as described above, the same result is ultimately provided to the player regardless of if the player selected to player individual hand one or individual hand two.

In another embodiment, the gaming device is operable to enable a player to play a plurality of interactive poker games simultaneously wherein the gaming device provides one or more predetermined game outcomes to the player. In one embodiment, a predetermined game outcome is selected for each individual poker game and while played simultaneously, the gaming device provides the player a separate predetermined game outcome for each individual poker game. In another embodiment, one or more of the simultaneously played poker games may be linked wherein the total outcome provided to the player for the sum of all the played poker games is equal to the selected predetermined game outcome. In another embodiment, the player is enabled to select a plurality of individual poker hands to actively play wherein each selected poker hand is provided the appropriate playing cards to correspond to a different predetermined game outcome.

In addition to providing a five card draw poker game which provides one or more predetermined game outcomes to a player, the present invention may be employed with other suitable types of poker games, such as Texas Hold'em. For example, in one Texas Hold'em embodiment, a player may be enabled to select which community cards to play with. In another embodiment, the gaming device may be employed in any other suitable non-poker interactive cards game, such as blackjack. In this embodiment, the gaming device displays at least one card of a plurality of initial blackjack hands, enables the player to select one of the initial blackjack hands and then determines and displays, based on the selected predetermined game outcome, zero, one or more playing cards for the selected blackjack hand. In one embodiment, the gaming device utilizes one or more automatic play rules or algorithms for the dealer to insure that the payout provided to the player for the selected blackjack hand corresponds with the selected predetermined game outcome.

In another embodiment, the gaming device is operable to provide a player a selected predetermined game outcome via a slot game. In this embodiment, a plurality of reels spin to generate, based on the selected predetermined game outcome, one or more symbols. Each symbol generated may be part of a symbol combination associated with a payout which corresponds with the payout of the selected predetermined game outcome. The gaming device enables the player to select a reel with a generated symbol or select a reel without a generated symbol. If the player selects a reel with a generated symbol, that generated symbol is held and will be part of the player's complete symbol combination. If the player selects a reel without a generated symbol, no generated symbols are held over to be part of the player's complete symbol combination. In this embodiment, the gaming device determines and generates, based on the selected predetermined game outcome, one or more symbols to form a symbol combination associated with a payout equal to the selected predetermined game outcome. For example, if the selected predetermined game outcome is a win $10 game outcome, the gaming device may initially reveal two different symbols on two selectable reels wherein each different symbol may be combined with zero, one or more other symbols to form a symbol combination associated with a payout equal to the selected predetermined win $10 game outcome.

Figure 5:
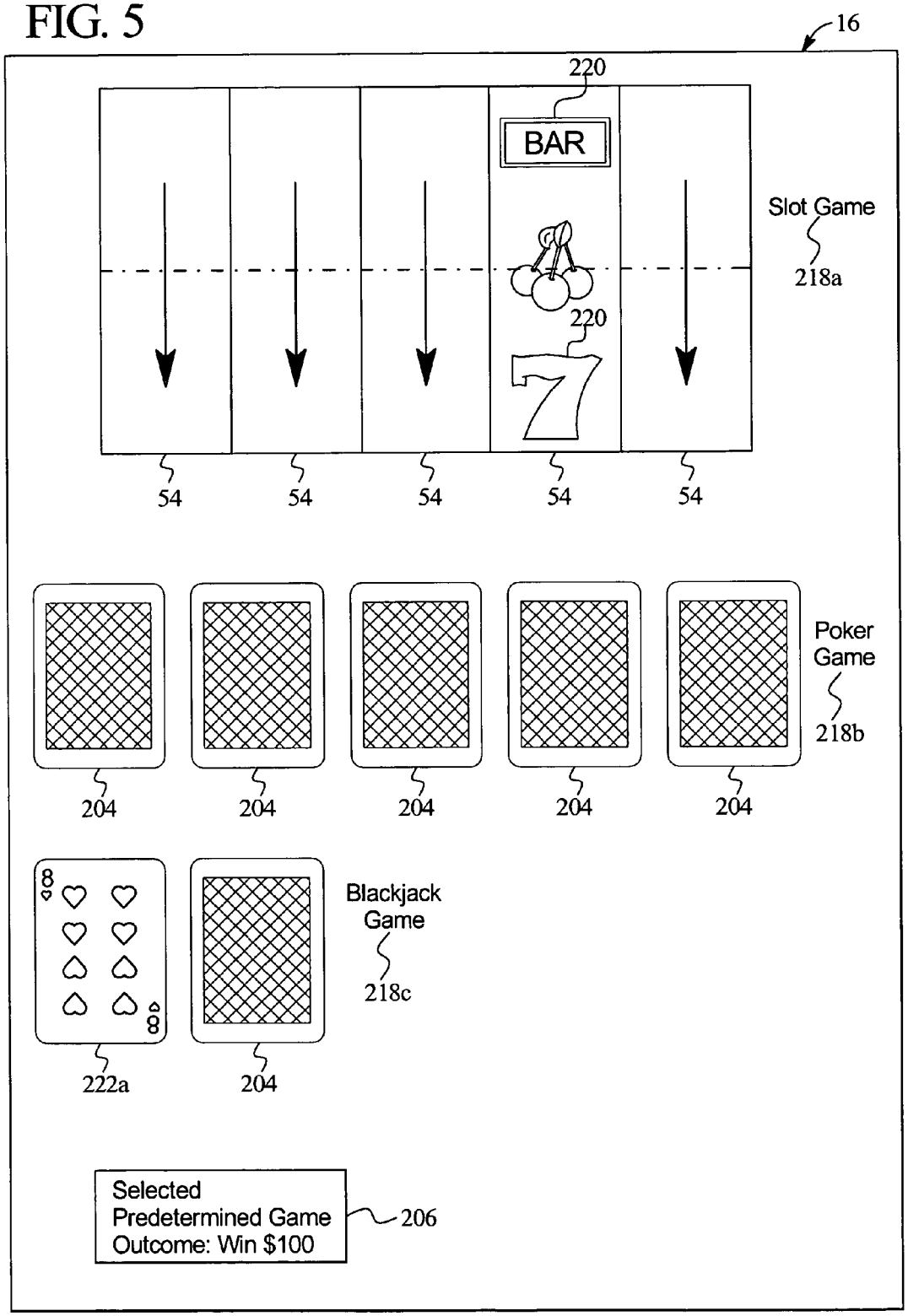
FIG. 5 is a top plan view of an alternative embodiment of the present invention illustrating a player selecting one of a plurality of different types of games to play.

In another embodiment, the gaming device is operable to enable a player to choose between which of a plurality of different games to play, wherein the selected predetermined game outcome is provided to the player regardless of which game the player picks to play. In this embodiment, one or more game elements of one or more of the games may be displayed to the player prior to enabling the player to select a game to play, wherein each displayed game element is based on the selected predetermined game outcome. For example, as illustrated in FIG. 5, the player is enabled to select to play either a slot game 218*a*, a draw poker game 218*b* or a blackjack game 218*c*. In this example, one or more symbols 220 are determined and generated on one or more of the reels 54 of the reel game and a eight of hearts playing card 222*a* is determined and displayed for the blackjack game. It should be appreciated that one or more game elements, in this example playing cards or reel symbols, may be determined and displayed based on the selected predetermined game outcome for one, more or each of the available games wherein each displayed symbol/playing card is determined based on the selected predetermined game outcome. In this embodiment, as described above, the player selects one of the plurality of available games and based on the selected game outcome, the gaming device provides the player an outcome for the selected game which corresponds with the selected predetermined game outcome.

In an alternative embodiment, the gaming device of the present invention is operable with a randomly determined game outcome. In this embodiment, upon the initiation of the gaming device, a randomly determined game outcome is determined using one or more random number generating algorithms. The gaming device then proceeds as described above via controlling each of the playing cards of the individual hands of playing cards to provide the player the randomly determined game outcome.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming device comprising:

at least one display device;

at least one input device;

at least one processor; and at least one memory device which stores a plurality of instructions, which when executed by the at least one processor, cause the at least one processor to operate with the at least one display device and the at least one input device to display a play of an interactive poker game upon a placement of a wager by a player, said play of the interactive poker game having a plurality of playing cards and a predetermined game outcome prior to displaying a face of any of said playing cards, said predetermined game outcome being one of: (i) a losing game outcome having a value of zero, or (ii) one of a plurality of different winning game outcomes, each having a value greater than zero, and for each play of the interactive poker game, said instructions including:

(a) instructions which cause the at least one processor and the least one input device to operate to enable the player to place the wager;

(b) instructions which, after the placement of the wager, cause the at least one processor and the least one display device to operate to display a plurality of separate hands of playing cards to the player, each of said hands of playing cards including a plurality of said playing cards, wherein at least one of said playing cards of at least one of said hands of playing cards is determined and displayed to the player based on said predetermined game outcome and at least one of said playing cards of at least one of said hands of playing cards is masked from the player;

(c) instructions which, after displaying the plurality of hands of playing cards, cause the at least one processor and the least one input device to operate to enable the player to select less than all of said plurality of hands of playing cards, wherein the selection of less than all of said plurality of hands of playing cards occurs distinct from the placement of the wager, and wherein the value of the predetermined game outcome will be provided to the player regardless of which of said plurality of hands of playing cards the player selects;

(d) instructions which cause the at least one processor to operate to determine, based on said predetermined game outcome, which of the playing cards to reveal for any masked playing cards in said selected hand of playing cards, such that said playing cards determined to be revealed in combination with any playing cards displayed in the selected hand of playing cards correspond to an award having a value equal to the value of said predetermined game outcome;

(e) instructions which cause the at least one processor and the least one display device to operate to reveal said playing cards determined to be revealed in said selected hand of playing cards;

(f) instructions which, after the selection of less than all of said plurality of hands of playing cards, cause the at least one processor to operate to randomly determine, regardless of the predetermined game outcome, which of the playing cards to reveal for at least one masked playing card in at least one non-player selected hand of playing cards;

(g) instructions which cause the at least one processor and the at least one display device to operate to display said at least one playing card determined to be revealed in said non-player selected hand of playing cards; and (h) instructions which cause the at least one processor to operate to provide the player the award having the value equal to the value of said predetermined game outcome after the playing cards of the selected hand of playing cards are revealed, said value of said predetermine game outcome being provided to the player regardless of which hand of playing cards is selected.

2. The gaming device of claim 1, wherein said at least one memory device stores a plurality of additional instructions, which when executed by the at least one processor, cause said at least one processor to operate with said at least one display device to determine which of the playing cards to reveal for any remaining masked playing cards for at least one non-player selected hand of playing cards and reveal said playing cards determined to be revealed in said non-player selected hand of playing cards.

3. The gaming device of claim 1, wherein said at least one memory device stores a plurality of additional instructions, which when executed by the at least one processor, cause said at least one processor to operate with said at least one display device to determine which of the playing cards to reveal for any remaining masked playing cards for said at least one non-player selected hand of playing cards and reveal said playing cards determined to be revealed in said non-player selected hand of playing cards.

4. The gaming device of claim 1, wherein said at least one memory device stores a plurality of additional instructions, which when executed by the at least one processor, cause said at least one processor to operate with said at least one display device to determine and display at least one of said playing cards for a plurality of said hands of playing cards, wherein said displayed playing cards are based on said predetermined game outcome.

5. The gaming device of claim 1, wherein said at least one memory device stores a plurality of additional instructions, which when executed by the at least one processor, cause said at least one processor to operate with said at least one display device to determine and display at least one of said playing cards for each of said hands of playing cards, wherein said displayed playing cards are based on said predetermined game outcome.

6. The gaming device of claim 1, wherein said at least one memory device stores a plurality of additional instructions, which when executed by the at least one processor, cause said at least one processor to operate with said at least one display device to determine and display a plurality of said playing cards for at least one of said hands of playing cards, wherein said displayed playing cards are based on said predetermined game outcome.

7. The gaming device of claim 1, wherein said at least one memory device stores a plurality of additional instructions, which when executed by the at least one processor, cause said at least one processor to operate with said at least one display device to determine and display a plurality of said playing cards for a plurality of said hands of playing cards, wherein said displayed playing cards are based on said predetermined game outcome.

8. The gaming device of claim 1, wherein said play of the interactive poker game includes at least three separate hands of playing cards and said at least one memory device stores a plurality of additional instructions, which when executed by the at least one processor, cause said at least one processor to operate with said at least one display device to determine and display each of said playing cards for at least one of said hands of playing cards, wherein said displayed playing cards are based on said predetermined game outcome.

9. The gaming device of claim 1, wherein said at least one memory device stores a plurality of additional instructions, which when executed by the at least one processor, cause said at least one processor to utilize a look-up table to determine which playing cards to reveal in said selected hand of playing cards.

10. The gaming device of claim 1, wherein said at least one memory device stores a plurality of additional instructions, which when executed by said at least one processor, cause said at least one processor to select said predetermined game outcome from a plurality of predetermined game outcomes.

11. The gaming device of claim 10, wherein said at least one memory device stores a plurality of additional instructions, which when executed by said at least one processor, cause said at least one processor to cause one of the plurality of predetermined game outcomes to have a value of zero.

12. The gaming device of claim 1, wherein said at least one memory device stores a plurality of additional instructions, which when executed by said at least one processor, cause said at least one processor to select said predetermined game outcome from the memory device.

13. The gaming device of claim 1, wherein said at least one memory device stores a plurality of additional instructions, which when executed by said at least one processor, cause said at least one processor to receive said predetermined game outcome from a central controller.

* * * * *